US005653430A

United States Patent [19]

Kawai

[11] Patent Number: 5,653,430

[45] Date of Patent: Aug. 5, 1997

[54] VENEER HOISTING APPARATUS

[75] Inventor: Kazuya Kawai, Chita-gun, Japan

[73] Assignee: Meinan Machinery Works, Inc., Obu, Japan

[21] Appl. No.: 541,881

[22] Filed: Oct. 10, 1995

[51] Int. Cl.[6] ..... B65H 3/22

[52] U.S. Cl. ..... 271/18.3; 294/61

[58] Field of Search ..... 271/18.3; 414/796.7, 414/796.9; 294/61

[56] References Cited

U.S. PATENT DOCUMENTS

| | | | |
|---|---|---|---|
| 4,165,811 | 8/1979 | Mainvielle | 271/18.3 |
| 4,838,536 | 6/1989 | Kamal | 271/18.3 |

FOREIGN PATENT DOCUMENTS

| | | | |
|---|---|---|---|
| 57-15775 | 1/1972 | Japan . | |
| 58-177838 | 10/1983 | Japan | 271/18.3 |
| 59-82251 | 5/1984 | Japan | 271/18.3 |
| 59-190138 | 10/1984 | Japan | 271/18.3 |

*Primary Examiner*—James W. Keenan
*Assistant Examiner*—Douglas Hess
*Attorney, Agent, or Firm*—Armstrong, Westerman Hattori, McLeland & Naughton

[57] ABSTRACT

A veneer hoisting apparatus in which at the hoisting of a veneer by a piercing body, the decrease in sustaining force applied to the veneer by the piercing body is prevented, and it rarely happens that the veneer drops down from the piercing body. With the construction of the piercing body 7 and a sustaining member 9, when the veneer is hoisted through the piercing body 7, although the central portion side of the veneer 5 in the direction of its fiber is hung down about the root of the piercing body 7 which pierces the veneer as a fulcrum, and the end side thereof is curved upward, no fulcrum occurs at a position apart from the root of the piercing body in the direction of the fiber of the veneer.

7 Claims, 19 Drawing Sheets

VENEER HOISTING APPARATUS

BACKGROUND OF THE INVENTION

1. Field of the Invention

The present invention relates to a veneer sheet hoisting apparatus.

2. Description of the Related Art

As a conventional apparatus for piercing by a piercing body and hoisting only one veneer sheet (hereinafter referred to as "veneer"), an apparatus disclosed in Japanese Utility Model Publication No. Showa 57-15775 is publicly known. The construction of this apparatus is exemplarily illustrated in FIGS. 1 and 2, and the piercing body 1 projects from a stopper 2 by the same height as the thickness of the veneer, and a cylinder vertically moves the stopper 2 and the piercing body 1 to pierce an end of the piled veneer taken in a direction of the fiber of the veneer and hoist it.

In the above-mentioned apparatus, however, following problems arise. That is, as illustrated in FIG. 2, when a veneer 5 is pierced and hoisted, the strength of the veneer in the direction vertical to its fiber is weak, so that the veneer hangs down from the root of the piercing body 1. However, off to the side of the central portion (left side in FIG. 2) of the veneer taken in the direction of its fiber, where the bulk density of the veneer is high, hangs down. As a result, the other side (right side in FIG. 2) is curved upward, and large force acts on the veneer 5 at the root of the piercing body 1 in the direction that the veneer is drawn from the piercing body 1, because the X portion of the stopper 2, spaced apart from the root of the piercing body 1 in the direction of its fiber, acts as a fulcrum (theory of lever). As a result, there are problems such that, for instance, the constant force applied to the veneer 5 by the piercing body 1 becomes weak and the veneer 5 drops from the piercing body 1.

SUMMARY OF THE INVENTION

This invention has been made to eliminate the problems described above, and the object thereof is to provide a veneer hoisting apparatus in which even if the central portion of the veneer in the direction of its fiber is hung down and the end side of a veneer is curved upward about the root of the piercing body which pierces the veneer, the relation between the piercing body and the veneer is designed so as not to generate a fulcrum at a position apart from the root of the veneer in the direction of its fiber, which prevents the above-mentioned force caused by the theory of lever from acting on the veneer, and therefore, the sustaining force applied to the veneer by the piercing body does not become weak nor the veneer rarely drops from the piercing body.

Concretely, a veneer hoisting apparatus for hoisting piled veneers from a top thereof according to the present invention comprises: a piercing body with a sharp tip; a sustaining member with a restricting bottom portion which abuts the top veneer piled, the sustaining member restricting a projecting length of the piercing body from the restricting bottom portion, when a veneer is pierced the sustaining member sustaining the veneer while causing the piercing body to project by substantially the same length as a thickness of the veneer; vertically transporting means for transporting the sustaining means between a position over the veneer and the top of the piled veneers; and a controller for controlling motion of the vertically transporting means, in which the sustaining member increases the projecting length of the piercing body when the sustaining member is moved over the veneer by the vertically transporting means.

In the above-mentioned veneer hoisting apparatus, the sustaining member may include vertical guide portions, a top position restricting portion and a bottom position restricting portion; the piercing body may include guided portions which are guided by the vertically guiding portions, and an upper limit restricted portion and a lower limit restricted portion which are restricted by the both restricting portions of the sustaining means; and the piercing body and the sustaining member may be connected to each other such that they are relatively vertically movable along the guided portions and vertically guiding portions.

As another veneer hoisting apparatus according to the present invention, in the apparatus described above, the vertically guiding portions and the guided portions may be engaged with each other while providing a play between them.

Further, a connecting means is preferably be provided between the sustaining member and the vertically transporting means; the top position restricting portion is preferably be formed on the connecting member; the sustaining body may be screwed at least at its sharp tip portion thereof and the upper limit restricted portion of the sustaining body is preferably be formed as a flat surface; and the top position restricting portion may contact at one point with the upper limit restricted portion, thereby the piercing body may be rotatable about an axis thereof.

Another veneer hoisting apparatus for hoisting piled veneers from a top thereof according to the present invention comprises: a piercing body with a sharp tip; a sustaining member with a restricting bottom portion at a lower end portion thereof which abuts the top veneer piled, the sustaining member sustaining the veneer while causing the piercing body to project by substantially the same length as a thickness of the veneer; vertically moving means for transporting the sustaining means between a position over the veneer and the top of the piled veneers; and a controller for controlling motion of the vertically moving means, in which the restricting bottom portion is provided at a lower end portion with at least one surface which extend in a direction perpendicular to fiber of the veneer, and is adjacent to the restricting bottom portion and is apart from the restricting bottom portion as ascending in a direction vertical to fiber of the veneer.

Further veneer hoisting apparatus for hoisting piled veneers from a top thereof comprises: a piercing body with a sharp tip; a sustaining member with a restricting bottom portion at a lower end portion thereof which abuts the top veneer piled, the sustaining member sustaining the veneer while causing the piercing body to project by substantially the same length as a thickness of the veneer; vertically moving means for transporting the sustaining means between a position over the veneer and the top of the piled veneers; and a controller for controlling motion of the vertically moving means, wherein the piercing body has at least the same dimension as the sustaining member in a direction of the fiber of the veneer.

When hoisted from the top of piled veneers through the piercing body, the central portion side of the veneer in the direction of its fiber is hung down about the root of the piercing body which pierces the veneer is curved upward. However, a fulcrum does not occur at a position apart from the root of the piercing body in the direction of the fiber of the veneer, so that no force on the basis of theory of lever is applied to the veneer by the piercing body.

BRIEF DESCRIPTION OF THE DRAWINGS

The present invention will be more apparent from the ensuring description with reference to the accompanying drawings wherein.

DETAILED DESCRIPTION OF THE PREFERRED EMBODIMENTS

Figure 3:
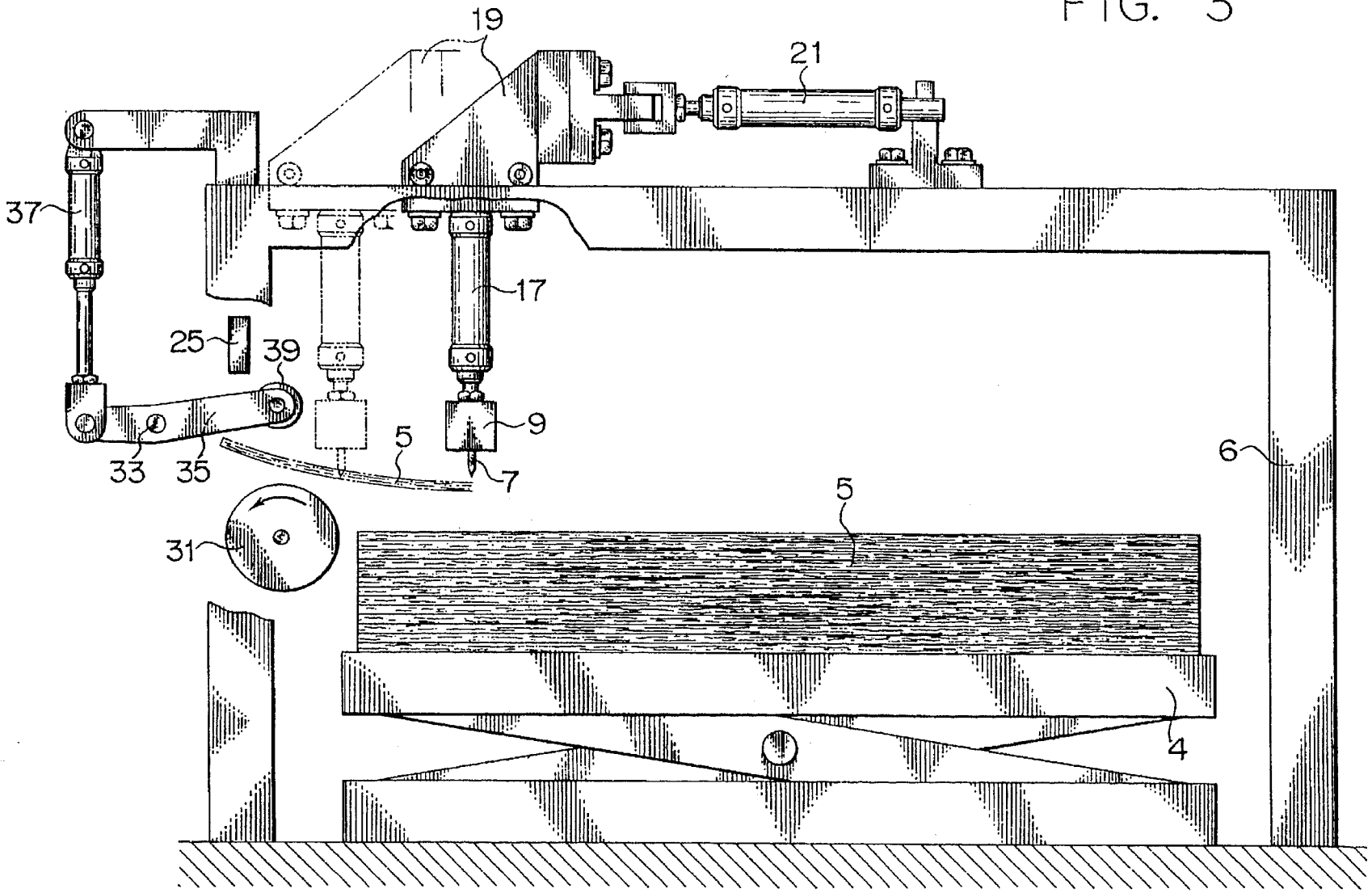
FIG. 3 is an overall view of the veneer hoisting apparatus.

Firstly, the first embodiment will be explained with reference to FIGS. 3 to 7. FIG. 3 is an overall view of the system observed in the direction perpendicular to the fiber of the veneer, and FIG. 4 is a partially cross-sectional view of the primary portion of the veneer hoisting apparatus illustrated in FIG. 3 that is observed in the direction perpendicularly to the fiber of a veneer in which a sustaining member 9 and a connecting member 11 are cut, and FIG. 5 is a partially cross-sectional view of the primary portion of the veneer hoising apparatus taken along the line V—V in FIG. 4, in which the sustaining means 9 and connecting member 11 are shown in section.

Figure 6:
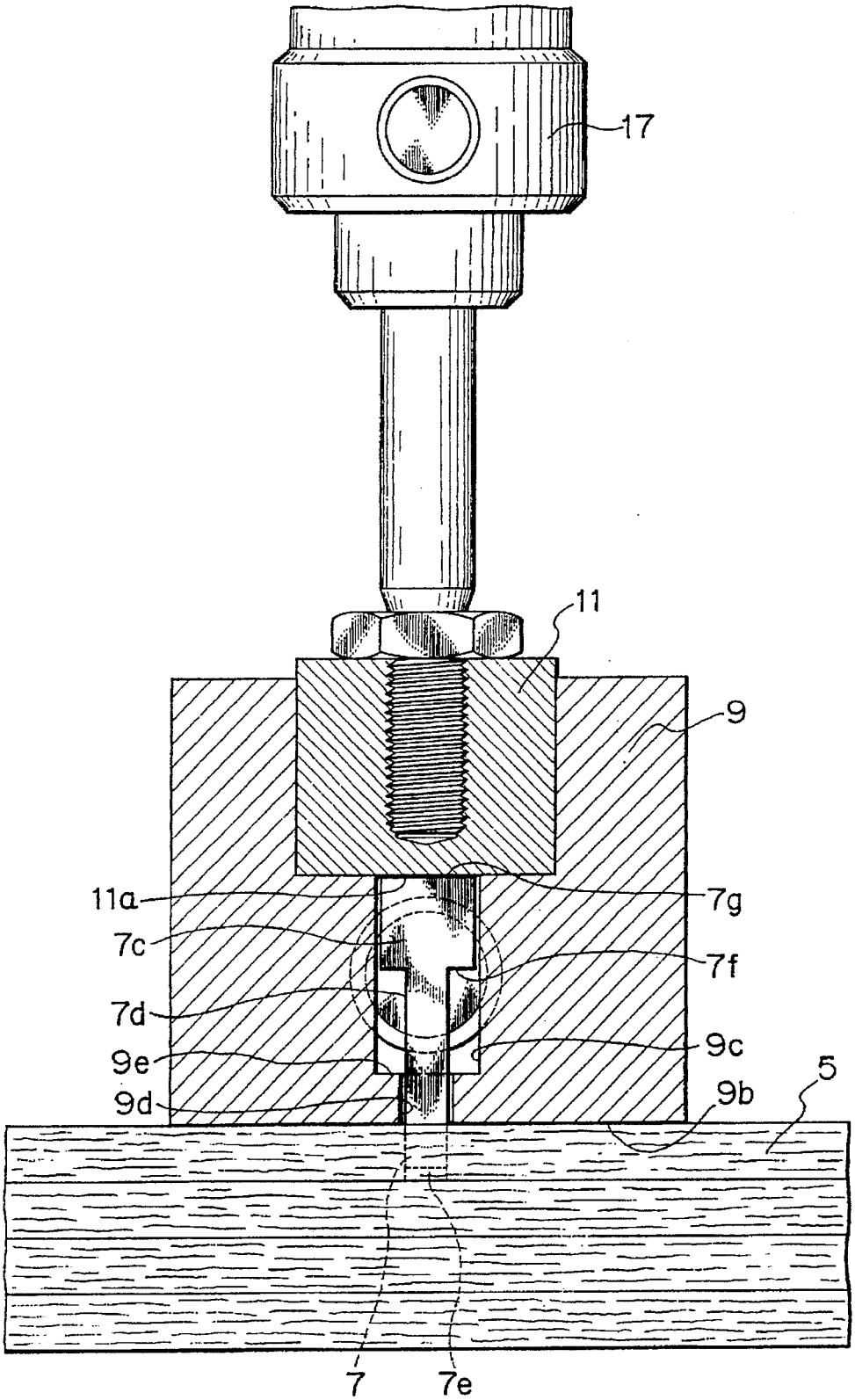
FIG. 6 is a view for explaining the motion of the veneer hoisting apparatus according to the first embodiment of the present invention.
Figure 7:
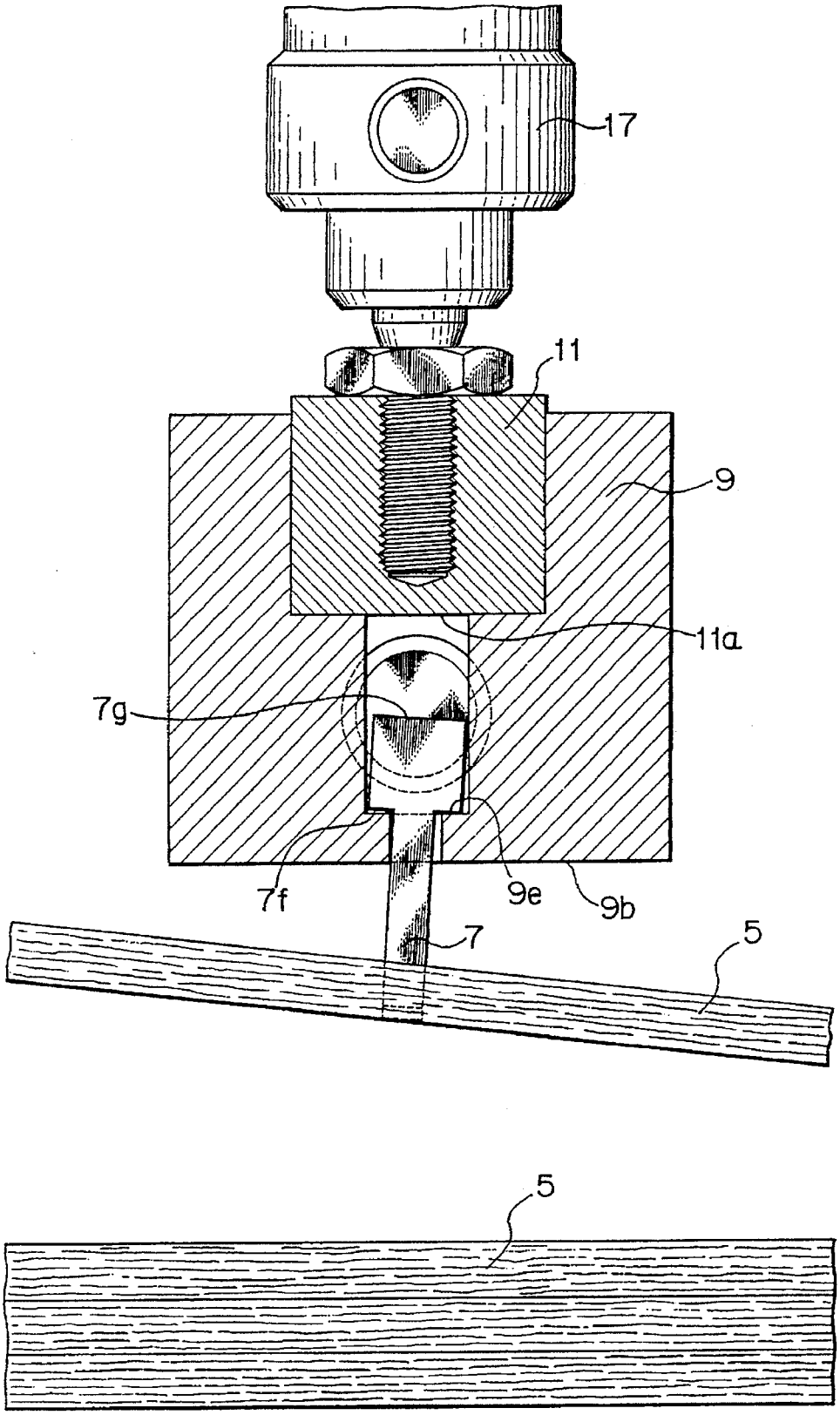
FIG. 7 is a view for explaining the motion of the veneer hoisting apparatus according to the first embodiment of the present invention.

FIG. 6 is a partially cross-sectional view when the veneer 5 is pierced by a piercing body 7 in which the sustaining means 9 and connecting member 11 are shown in section, and FIG. 7 is a partially cross-sectional view when the veneer 5 pierced by the piercing body 7 as illustrated in FIG. 7 is hoisted, in which the sustaining means 9 and connecting member 11 are cut.

Reference numeral 4 shows an elevating table on which veneers are piled, and numeral 5 are the veneers piled on the elevating table 4. The fiber of the veneer runs in the right and left directions in FIG. 3. Numeral 6 shows a frame, and 17 is a cylinder vertically moving as a elevating means, and a piston rod of the vertically transporting cylinder 17 is provided with a rotation preventing mechanism. Numeral 19 shows a movable body which is mounted to the frame 6 so as to be substantially horizontally movable in relation to the frame 6, and a cylinder tube of the vertically transporting cylinder 17 is attached thereto. Numeral 21 shows a horizontally moving cylinder as a horizontally transporting means, and its cylinder tube is movably attached to the frame 6 and the piston rod thereof is movably attached to the movable body 19 respectively. Reference numeral 25 shows a detector such as a photocell and a limit switch to detect the existence of the veneer 5, and 31 shows a roller for transporting the veneer 5 to the next process. The roller 31 is rotatably (not shown) attached to the frame 6, and a motor (not shown) is connected thereto. Numeral 39 is a striking roll for supporting the veneer 5 in combination with the discharging roll 31, and the striking roll 39 is rotatably supported on an arm 35. The arm 35 is rotatable by the striking cylinder 37 about a shaft 33 fixed to the frame 6, but this relation between the frame 6 and the shaft 33 is not shown in the drawings.

Figure 4:
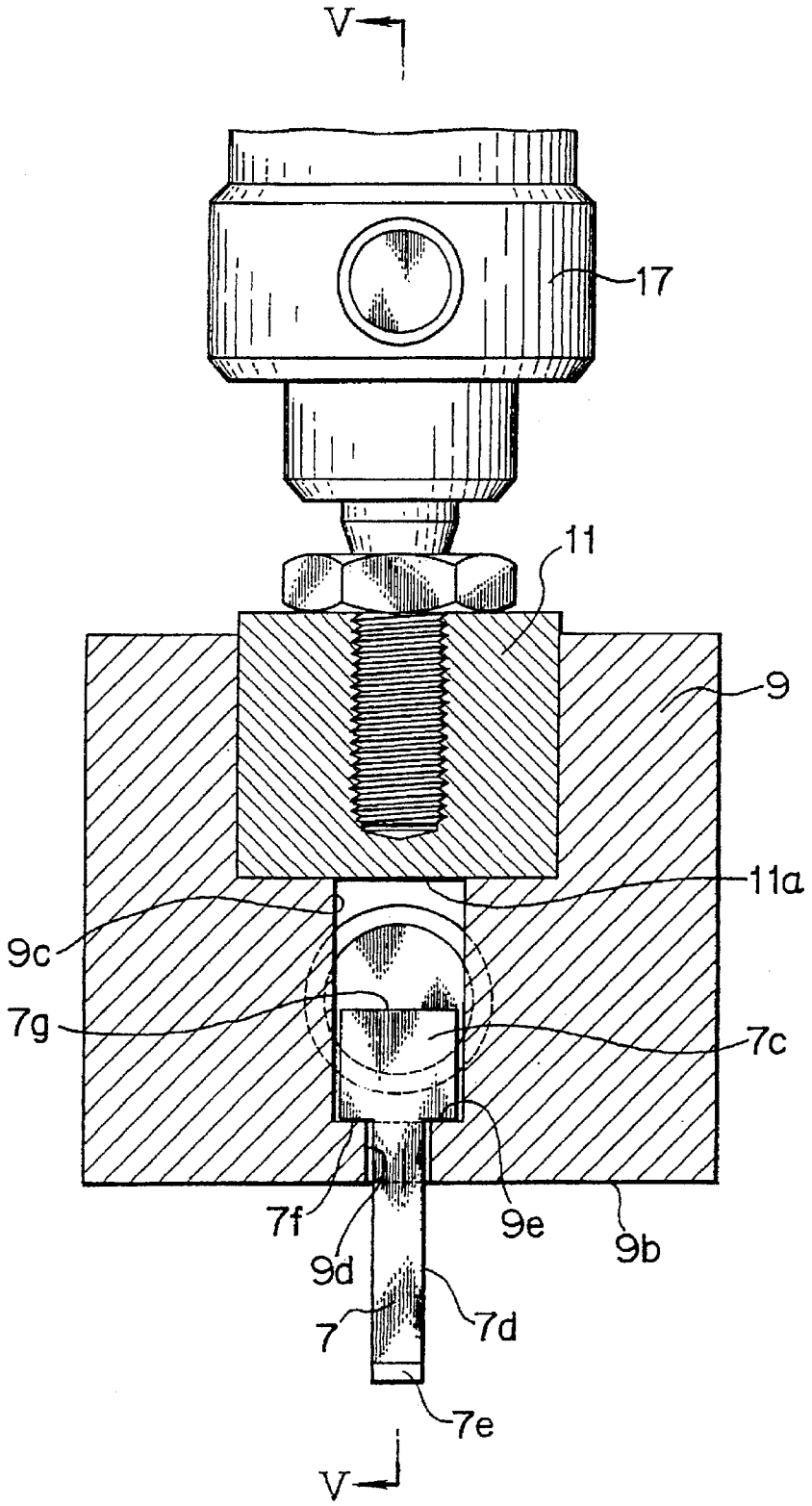
FIG. 4 is an enlarged view of a primary portion of the veneer hoisting apparatus illustrated in FIG. 3 in which the sustaining means 9 and the connecting member 11 are cut.
Figure 5:
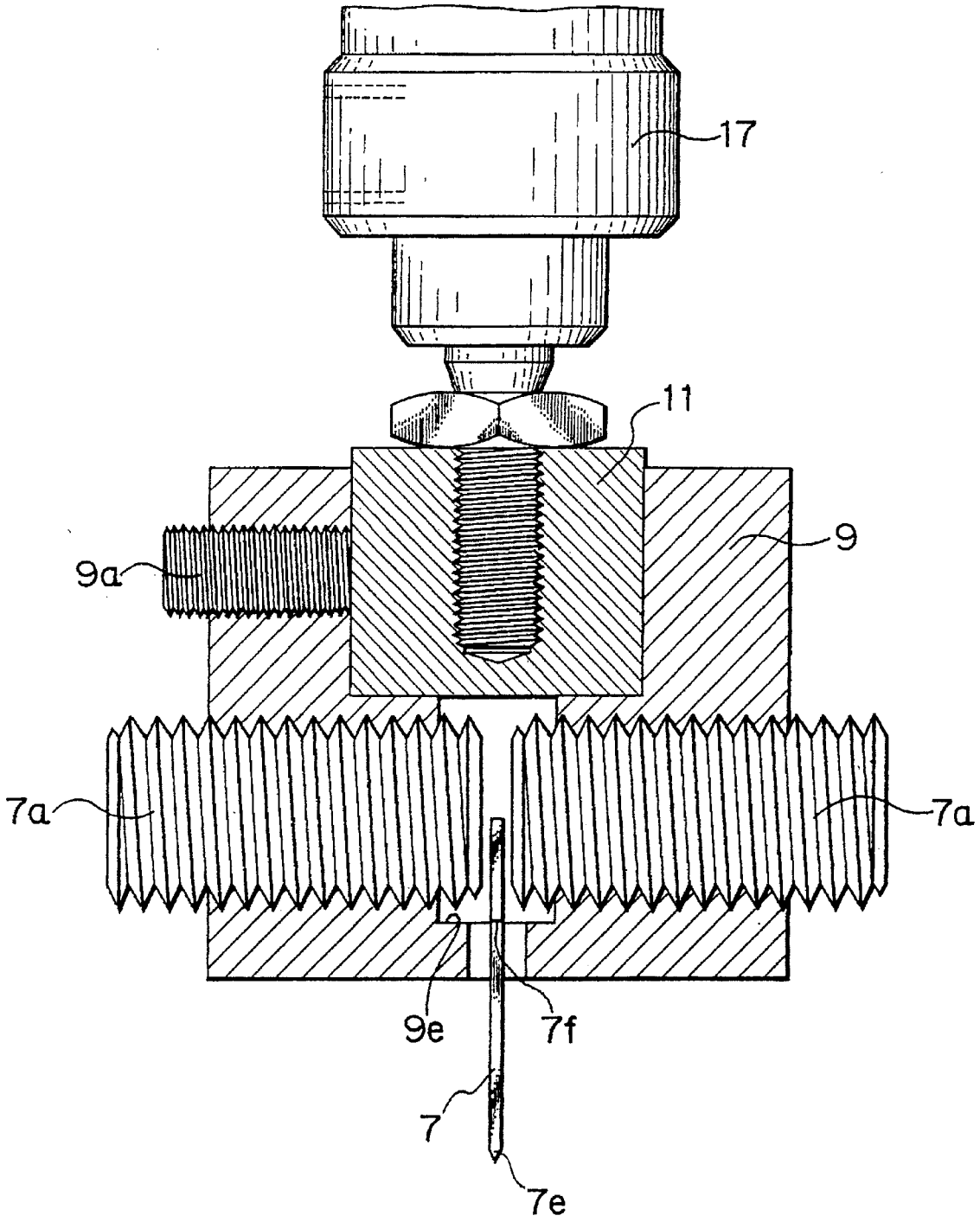
FIG. 5 is a partially cross-sectional view of the veneer hoisting apparatus that is taken long the line V—V in FIG. 4 in which the sustaining means 9 and the connecting member 11 are cut.

As illustrated in FIG. 4, numeral 11 shows a connecting member which is attached to the piston rod of the vertically transporting cylinder 17 and is provided with a top position restricting portion 11*a* for restricting the top position of the piercing body 7 which is described below. The connecting member 11 constitutes the sustaining means 9 described below. Numeral 7 shows the piercing body and is provided with a sharp tip 7*e*, guided portions 7*c* and 7*d*, a top position restricted portion 7*g*, and a bottom position restricted portion. Numeral 9 shows a sustaining member with a restricting bottom portion 9*b* for restricting the piercing depth of the piercing body 7, and the sustaining member 9 are provided with vertical guide portions 9*c* and 9*d*, and a bottom portion restricting portion 9*e*. The piercing body 7 and the sustaining means 9 are connected to each other such that they are relatively vertically movable along the guided portions 7*c* and 7*d*, and the vertically guiding portions 9*c* and 9*d*. The sharp tip 7*e* of the piercing body 7 projects below from the restricted bottom portion 9*b* by substantially the same height as the thickness of the veneer 5 under the condition that a top limit restricted portion 7*g* and the top position restricting portion 11*a* abut with each other (as described in FIG. 6). Further, screws 7*a* for restricting the rotation of the piercing body 7 as illustrated in FIG. 5 are screwed into the piercing body 7 from both sides thereof to provide appropriate interval between opposite ends of the screws 7*a*. A plurality of vertically transporting cylinders 17 (not shown) are disposed on the movable body 19 in the direction vertical to the fiber of a veneer, and each of the vertically transporting cylinder 17 is provided with the connecting member 11, the sustaining member 9 and the piercing body 7. Based on signals from the sensor 25 showing whether or not a veneer exists, a controller (not shown) for controlling the motion of the vertically transporting cylinder 17, horizontally transporting cylinder 21 and the striking cylinder 37 as described below is provided.

Now, the motion of the veneer hoisting apparatus according to the first embodiment will be explained. In initial state, as illustrated by solid lines in FIG. 3, the piston rods of the vertically transporting cylinder 17 and the horizontally transporting cylinder 21 are shrunk, and the piston rod of the striking cylinder 37 is stretched. The elevating table 4 on which the veneers 5 are piled is controlled in height through appropriate sensors (not shown), so that the surface of the veneers 5 are always maintained at appropriate height. The piercing body 7 is positioned above the left end of the veneer 5 in the direction of its fiber, and this position is defined as a standby position before hoisted, and as illustrated in FIG. 4, the lower limit restricted portion 7*f* and the bottom portion restricting portion 9*e* abut with each other due to the own weight of the piercing body 7. Then, based on the detecting signal from the detector 25 which shows whether or not a veneer exists, a signal from the controller sets time required to cause the vertically transporting cylinder 17, the horizontally transporting cylinder 21 and the striking cylinder 37 to be shrunk or stretched by way of delaying device such as timers (not shown) and are outputted from the controller in accordance with the order of the motions.

In initial state, a signal from the detector 25 showing no veneer is transmitted to the controller. Then, the signal causes the piston rod of the vertically transporting cylinder 17 to be stretched, which allows the sustaining means 9 to move downward. As a result, the sharp tip 7*e* of the piercing body 7 abuts the veneer 5, however, the piercing body 7 is pushed by the veneer 5 so as to move upward along the vertically guiding portions 9*c* and 9*d* in the sustaining means 9, and when the upper limit restricted portion 7*g* of the piercing body 7 abuts the top position restricting portion 11*a* the movement of the piercing body 7 is restricted. Then, the sustaining means 9 further moves downward and the sharp tip 7*e* of the piercing body 7 pierces the veneer 5, which permits the restricting bottom portion 9*b* of the sustaining means 9 to abut the surface of the veneer 5. Hereinafter, even if the sustaining means 9 slightly moves downward, the relative position between the sustaining means 9 and the veneer 5 does not change, which allows the piercing body 7 to pierce only one veneer 6 (as illustrated in FIG. 6).

After the piston rod of the vertically transporting cylinder 17 is stretched, a signal from the vertically transporting cylinder 17 causes the piston rod of the vertically transporting cylinder 17 to be shrunk to move the sustaining means 9 upward, causing the restricting bottom portion 9*b* of the sustaining means 9 to be detached from the surface of the veneer 5. Then, as the sustaining means 9 further moves upward, the lower limit restricted portion 7*f* of the piercing body 7 abuts the bottom portion restricting portion 9*e* of the sustaining means 9 and is moved upward with the piercing body 7 piercing the veneer 5 (as illustrated in FIG. 7). In other words, the veneer 5 is in the state that it is pierced by the piercing body 7 at a position apart from the restricting bottom portion 9*b*. At that moment, since the right side of FIG. 7 shows the central portion side of the veneer 5 in the direction of its fiber, the right side thereof is hung down and the left side is curved upward, but the veneer 5 is already pierced in the previous state so that no fulcrum occurs at a position apart from the root of the piercing body 7 in the direction of the fiber of the veneer, resulting in no force for detaching the veneer 5 from the piercing body 7 on the basis of the theory of lever.

After the piston rod of the vertically transporting cylinder 17 is shrunk, a signal from the controller causes the piston rod of the horizontally transporting cylinder 21 to be stretched to move the movable body 19, the vertically transporting cylinder 17, the piercing body 7 and the hoisted veneer 5 to standby position before inserted (the portion indicated by the two-dot chain line in FIG. 3). Then, a signal showing the existence of a veneer is transmitted to the controller from the detector 25, and a signal from the controller causes the piston rod of the striking cylinder 37 to be shrunk. As a result, the striking roll 39 moves downward to allow the veneer 5 to be drawn from the piercing body 7, and then the veneer 5 is sustained by the roller 31 and the striking roll 39 to be transported to the next process. Next, after the piston rod of the striking cylinder 37 is shrunk, a signal from the controller causes the piston rod of the horizontally transporting cylinder 21 to be shrunk, which allows the vertically transporting cylinder 17 and the piercing body 7 to be hoisted and returned the standby positions before hoisted (the position shown by the solid line in FIG. 3). After the transportation of the veneer 5 to the next process is completed, a detecting signal showing no veneer is sent to the controller from the detector 25. Then, a signal from the controller allows the piston rod of the striking cylinder 37 to be stretched and returned to the initial state. The above-mentioned motions are repeatedly performed to hoist and transport veneers one after another.

In case that the piercing body 7 fails to pierce the veneer 5 due to some cause, even if the movable body 19 and others were moved to the standby position before inserted, no detecting signal indicating the existence of a veneer would be outputted from the detector 25. At that time, a signal from the controller causes the above elements to be returned to their initial states to repeat the same procedure again.

As described above, in the first embodiment, although the central portion side of the veneer 5 in the direction of its fiber is hung down and the end side thereof is curved upward about the root of the piercing body 7 piercing the veneer 5 as a fulcrum, no fulcrum occurs at a position apart from the root of the piercing body 7 in the direction of the fiber of the veneer, permitting no force for detaching the veneer 5 from the piercing body 7 based on the theory of lever to act on the veneer. Therefore, it is prevented to decrease the sustaining force applied to the veneer 5 by the piercing body 7, and it rarely happens that the veneer 5 drops down from the piercing body 7.

Figure 9:
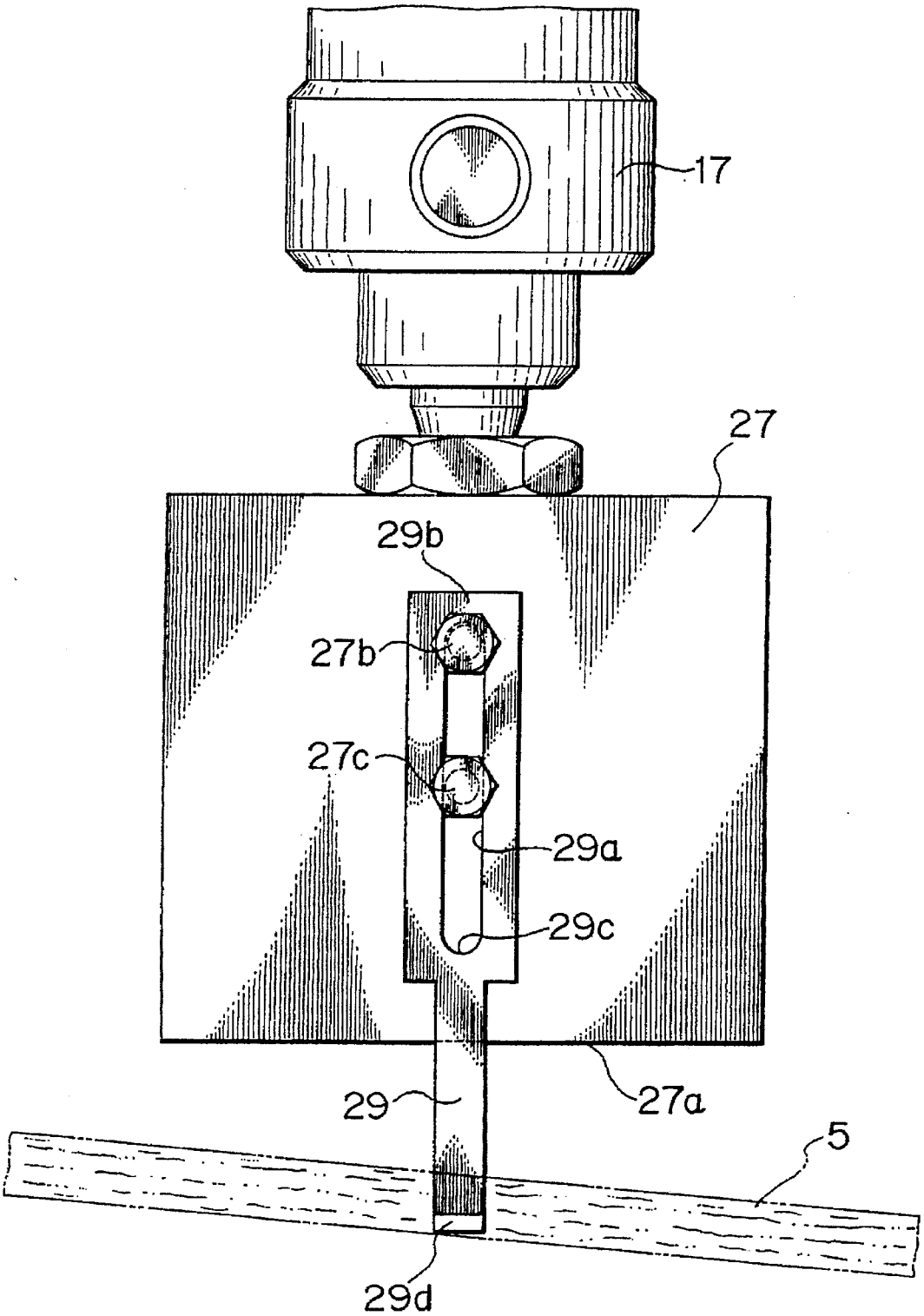
FIG. 9 is a view for explaining the veneer hoisting apparatus according to the second embodiment of the present invention which is observed in the direction vertical to the fiber of a veneer.

Now, the second embodiment (an embodiment relating to the invention described in claim 1) will be explained with reference to FIG. 9. FIG. 9 is a partial view of the veneer hoisting apparatus according to the present invention which is observed in the direction of the fiber of a veneer. In comparison with the first embodiment, members other than the member which is vertically moved by the vertically transporting cylinder 17 are the same as those in the first embodiment in construction and motion, so that the explanation thereof will be omitted. Reference numeral 29 shows a piercing body with a sharp tip 29*d*, and a long hole comprising a guided portion 29*a*, a lower limit restricted portion 29*b* and an upper limit restricted portion 29*c* is formed. Numeral 27 shows a sustaining member with a restricting bottom portion 27*a* for restricting the piercing depth of the piercing body 29. In order to connect the piercing 29 and the sustaining member 27 to each other so as to be relatively and substantially vertically movable, a piercing body upper limit bolt 27*c* as a vertical guide portion and top portion restricting portion, and a piercing body lower limit bolt 27*b* as a vertical guide portion and bottom position restricting portion pass through the long hole of the piercing body 29 and are mounted to the sustaining member 27 to allow the vertical movement of the piercing body 29. In the state that the upper limit restricted portion 29*c* and the piercing body upper limit bolt 27*c* are in contact with each other, the sharp tip 29*d* of the piercing body 29 projects downward from the restricting bottom portion 27*a* by the length corresponding to substantial thickness of the veneer 5.

With the construction described above, like the first embodiment, when a signal from the controller causes the piston rod of the vertically transporting cylinder 17 to be stretched, the sustaining member 27 moves downward and the sharp tip 29*d* of the piercing body 29 abuts the veneer 5, however, the piercing body 29 is pushed by the veneer 5 and is moved upward along the piercing body upper limit bolt 27*c* and the piercing body lower limit bolt 27*b*. As a result, the upper limit restricted portion 29*c* at the lower portion of the long hole of the piercing body 29 contacts the piercing body upper limit bolt 27*c* to restrict the movement of the piercing body 29, Then, the sustaining member 27 is further moved downward, and the sharp tip 29*d* of the piercing body 29 pierces the veneer 5, which permits the restricting bottom portion 27*a* of the sustaining member 27 to abut the surface of the veneer 5. Hereinafter, even if the sustaining member 27 slightly moved downward, the relative position between the sustaining member 27 and the veneer 5 would not change, permitting only one veneer 5 to be pierced by the piercing body 29.

After the piston rod of the vertically transporting cylinder 17 is stretched, like the first embodiment, a signal from the controller causes the piston rod of the vertically transporting cylinder 17 is shrunk, and the sustaining member 27 is elevated, so that the restricting bottom portion 27*a* of the sustaining member 27 is detached from the surface of the veneer 5. Then, the sustaining member 27 is further elevated to cause the piercing body lower limit bolt 27*b* to contact the lower limit restricting portion 29*b* at the upper portion of the long hole of the piercing body 29 to allow the piercing body 29 to move upward while piercing the veneer 5. In other words, the veneer 5 is in the state that it is pierced by the piercing body 29 at a position apart from the restricting bottom portion 27*a*. At that moment, since the right side of FIG. 9 shows the central portion side of the veneer 5 in the direction of its fiber, the right side thereof is hung down and the left side is curved upward, but the veneer 5 is already pierced in the previous state, so that no fulcrum occurs at a position apart from the root of the piercing body 7 in the direction of the fiber of the veneer, resulting in no force for detaching the veneer 5 from the piercing body 29 on the basis of the theory of lever.

As described above, in the second embodiment, although the central portion side of the veneer in the direction of its fiber is hung down and the end side thereof is curved upward about the root of the piercing body 29 piercing the veneer 5 as a fulcrum, however, no fulcrum occurs at a position apart from the root of the piercing body 29 in the direction of the fiber of the veneer, permitting no force for detaching the veneer 5 from the piercing body 7 based on the theory of lever to act on the veneer. Therefore, it is prevented to decrease the sustaining force of the veneer 5 by the piercing body 29, and it rarely happens that the veneer 5 drops down from the piercing body 29.

Figure 18:
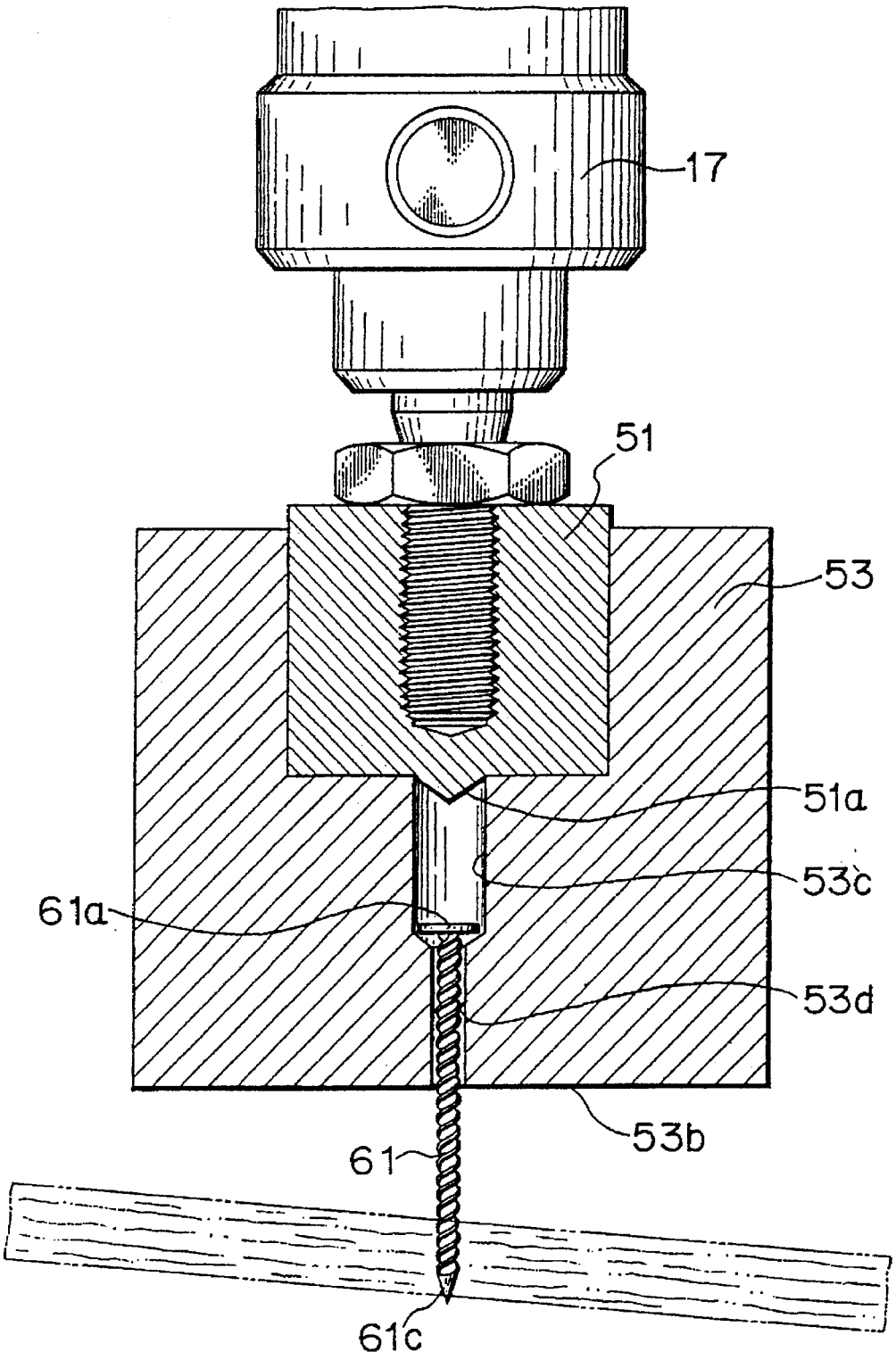
FIG. 18 is a partially cross-sectional view of the veneer hoisting apparatus according to the third embodiment of the present invention which is observed in the direction of the fiber of the veneer in which the sustaining member 53 the and connecting member 51 are cut.
Figure 19:
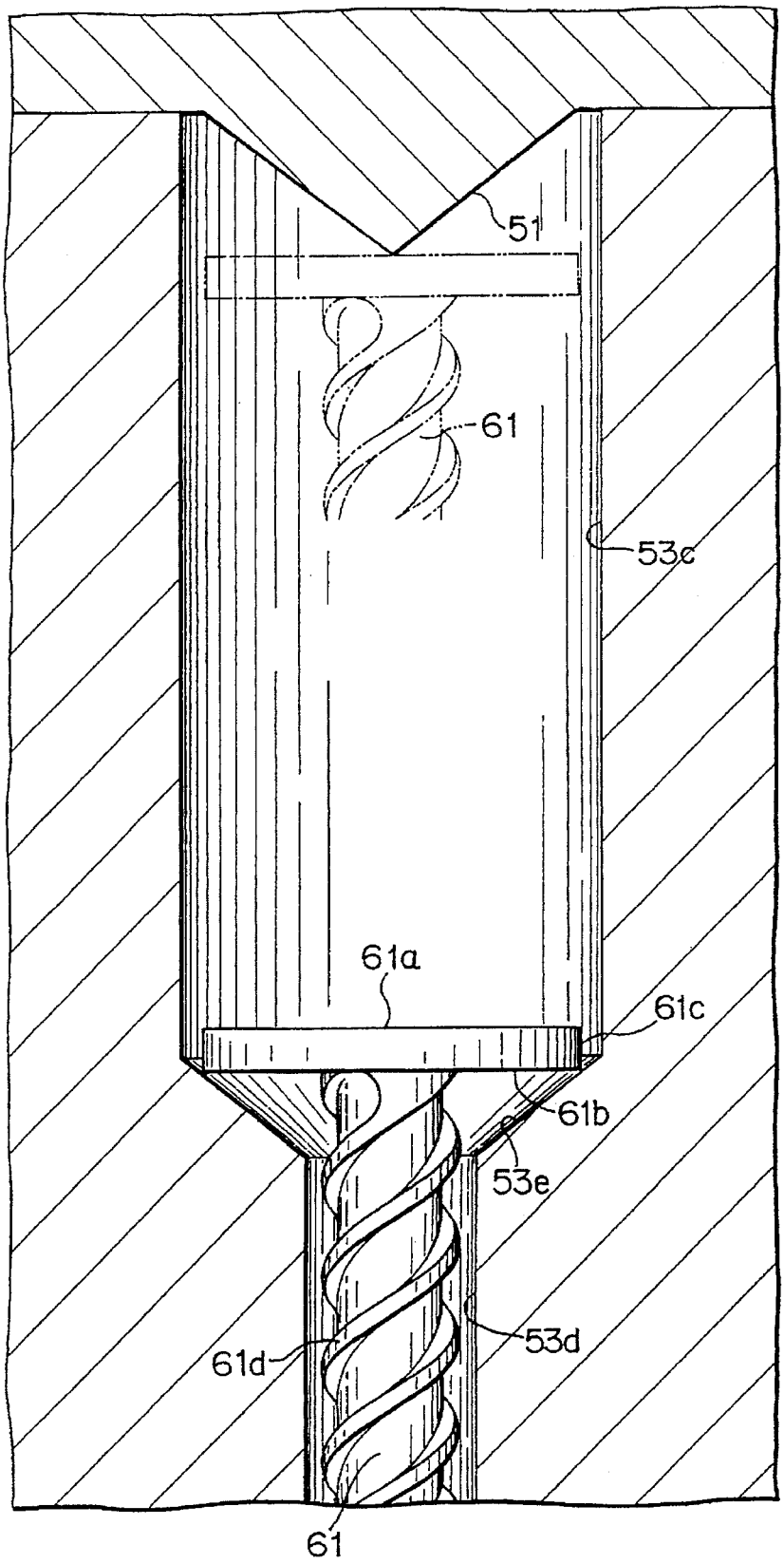
FIG. 19 is a partially enlarged view of the veneer hoisting apparatus shown in FIG. 18.

The veneer hoisting apparatus according to the third embodiment of the present invention (relating to the embodiment stated in claim 1) will be explained with reference to FIGS. 18 and 19. FIG. 18 is a partially cross-sectional view of the veneer hoisting apparatus according to the present invention in which a connecting member 51 and a sustaining member 53 which are observed in the direction perpendicular to the fiber of a veneer, and FIG. 19 is a partially enlarged view of those members in FIG. 18. In comparison with the first embodiment, since members in this embodiment other than the member which is vertically transported by the vertically transporting cylinder 17 are the same as those in the first embodiment in construction and motion, the explanation thereof will be omitted. Numeral 51 shows the connecting member which is attached to the piston rod of the vertically transporting cylinder 17 and is provided with a concaved top position restricting portion 51*a* for restricting a top position of a piercing body 61 described below. This connecting member 51 constitutes the sustaining member 53 described below. Numeral 61 shows the piercing body with a sharp tip 61*e*, and comprises guided portions 61*c* and 61*d*, a lower limit restricted portion 61*b* and an upper limit restricted portion 61*a*. Numeral 53 shows the sustaining member with a restricting bottom portion 53*b* for restricting the piercing depth of the piercing body 61, and comprises vertical guide portions 53*c* and 53*d*, and a bottom position restricting portion 53*e*. The piercing body 61 and the sustaining member 53 are connected to each other so as to relatively vertically move along the guided portions 61*c* and 61*d* and the vertical guide portions 53*c* and 53*d*, and the sharp tip 61*e* of the piercing body 61 projects downward from the restricting bottom portion 53*b* by the length corresponding to a substantial thickness of the veneer 5 under the condition that the upper limit restricting portion 61*a* and the top position restricting portion 51*a* are in contact with each other (the condition shown by the two-dot chain line in FIG. 19).

Figure 1:
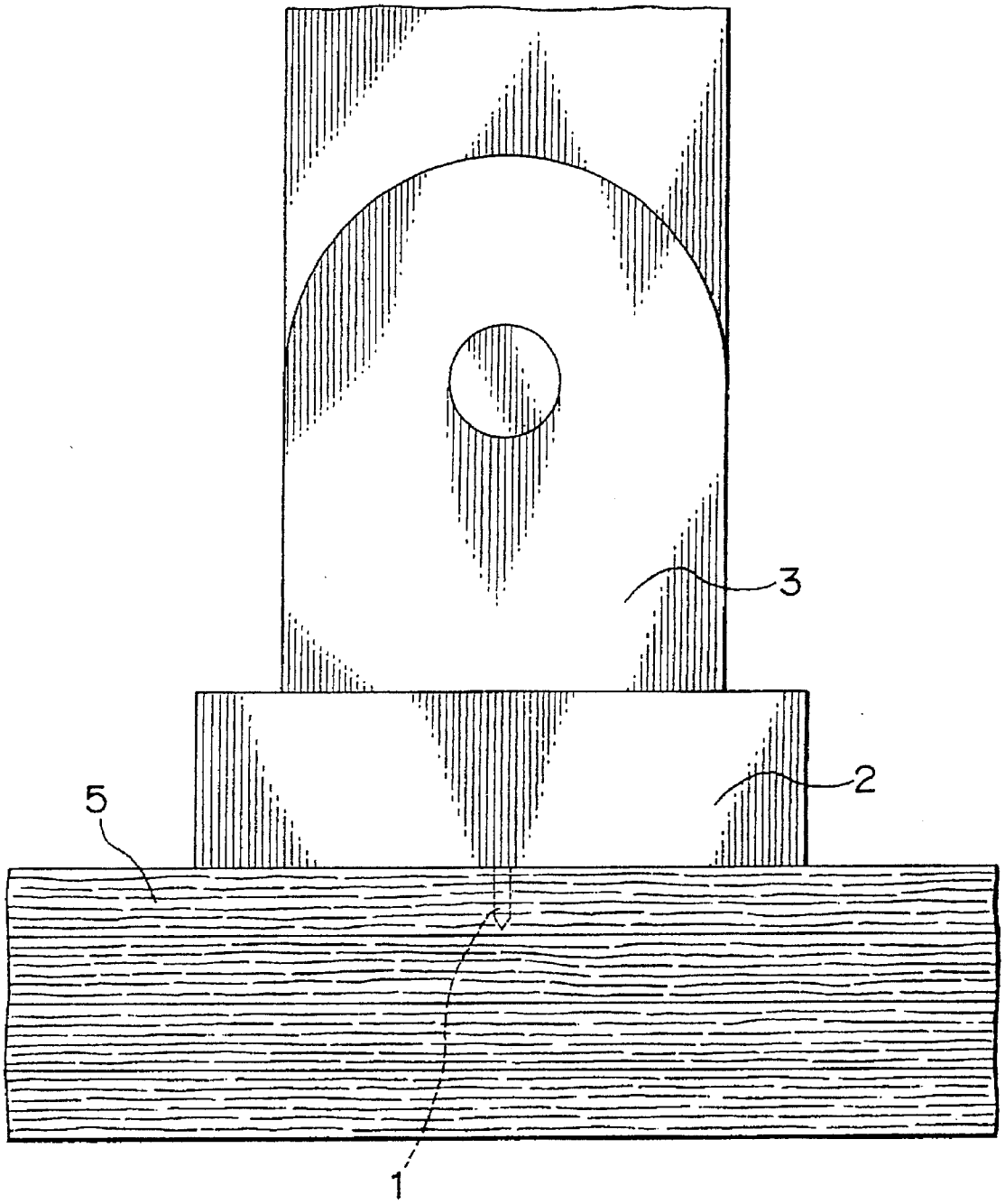
FIG. 1 PRIOR ART
FIG. 1 is a drawing for explaining a conventional veneer hoisting apparatus which is observed in the direction vertical to the fiber of a veneer.
Figure 2:
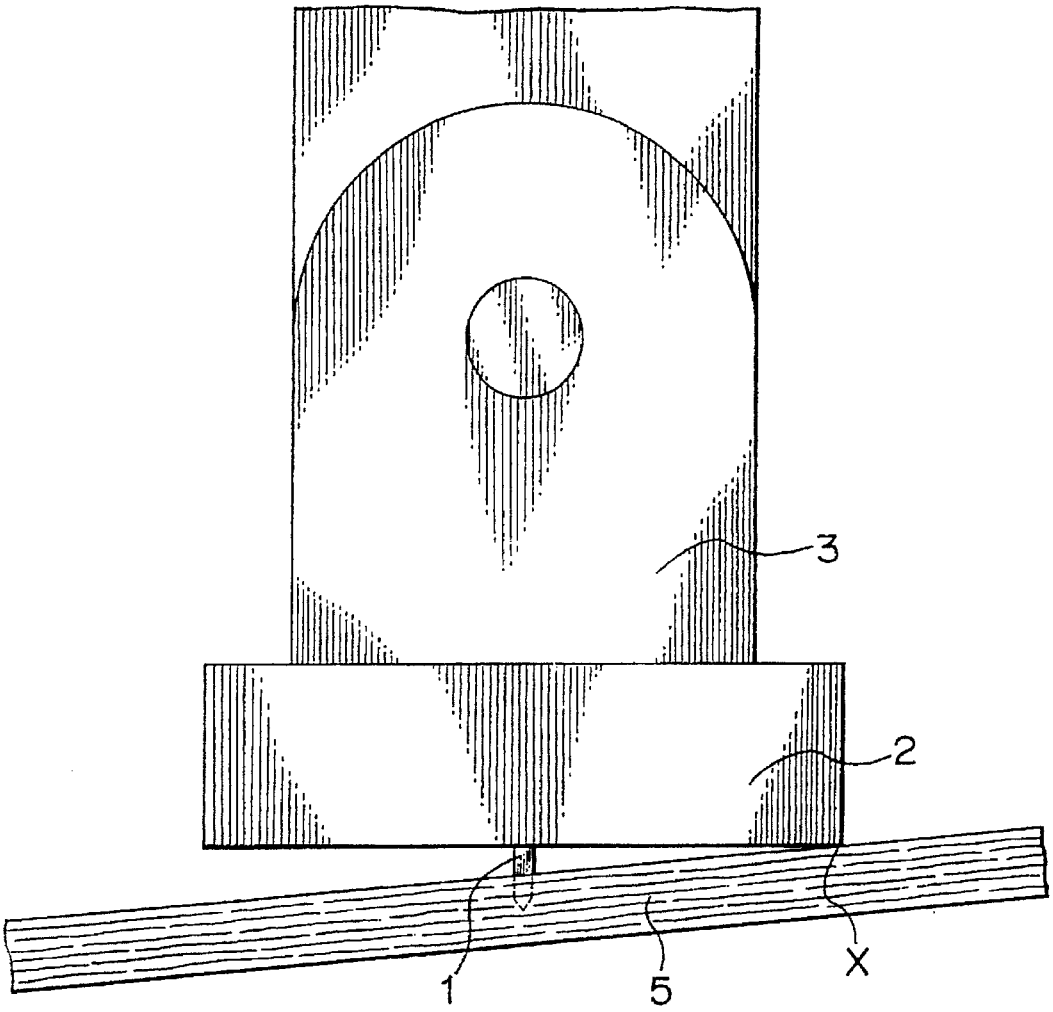
FIG. 2 PRIOR ART
FIG. 2 is a partial view of the conventional veneer hoisting apparatus which is observed in the direction vertical to the fiber of the veneer.
Figure 2:
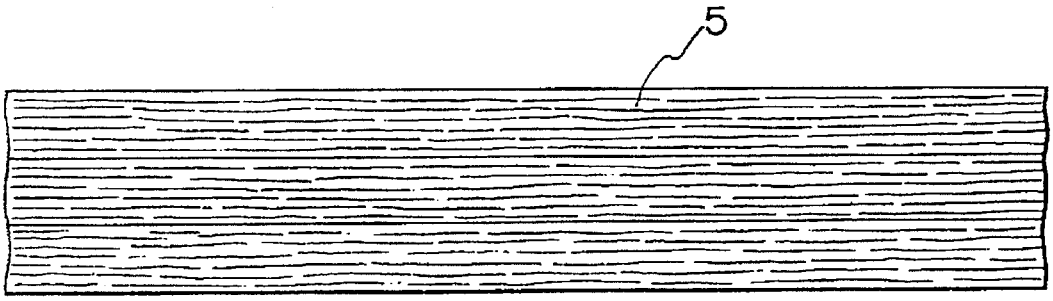
FIG. 2 PRIOR ART

With the above-mentioned construction, like the first embodiment, when a signal from the controller causes the piston rod of the vertically transporting cylinder 17 to be stretched, the sustaining member 53 drops and the sharp tip 61*e* of the piercing body 61 abuts the veneer 5, however, the piercing body 61 is pushed by the veneer 5 to move upward in the sustaining member 53 along the vertical guide portions 53*c* and 53*d*, and a substantial central portion of the upper limit restricting portion 61*a* of the piercing body 61 abuts the concaved portion of the top position restricting portion 51*a* (the condition indicated by the two-dot chain line in FIG. 1) to prevent the movement of the piercing body 61. Then, the sustaining member 53 further moves downward and the sharp tip 61*e* of the piercing body 61 pierces the veneer 5 while rotating, which causes the restricting bottom portion 53*b* of the sustaining member 53 to abut the surface of the veneer 5. Hereinafter, even if the sustaining member 53 slightly moved downward, the relative position of the sustaining member 53 and the veneer 5 would not change, permitting only one veneer 5 to be pierced by the piercing body 61.

After the piston rod of the vertically transporting cylinder 17 is stretched, like the first embodiment, a signal from the controller allows the piston rod of the vertically transporting cylinder 17 to be shrunk, which causes the sustaining member 53 to move upward. As a result, the restricting bottom portion 53*b* of the sustaining member 53 is detached from the surface of the veneer 5. As the sustaining member 53 further moves upward, the lower position restricting portion 53*e* abuts the outer peripheral portion of the lower limit restricting portion 61*b* of the piercing body 61 while preventing the rotation of the piercing body 61, and the piercing body 61 elevates while piercing the veneer 5. In other words, the veneer 5 is maintained in the state that it is pierced by the piercing body 61 at a position apart from the restricting bottom portion 53*b*. At that moment, since the right side of FIG. 18 shows the central portion side of the veneer 5 in the direction of its fiber, the right side thereof is hung down and the left side is curved upward, but the veneer 5 is already pierced in the previous state so that no fulcrum occurs at a position apart from the root of the piercing body 61 in the direction of the fiber of the veneer, resulting in no force for detaching the veneer 5 from the piercing body 61 on the basis of the theory of lever.

As described above, in the third embodiment, although the central portion side of the veneer in the direction of its fiber is hung down and the end side thereof is curved upward about the root of the piercing body 61 piercing the veneer 5 as a fulcrum, no fulcrum occurs at a position apart from the root of the piercing body 61 in the direction of the fiber of the veneer, permitting no force for detaching the veneer 5 from the piercing body 61 based on the theory of lever to act on the veneer. Therefore, it is prevented to decrease the sustaining force of the veneer 5 by the piercing body 61, and it rarely happens that the veneer 5 drops down from the piercing body 61. Besides, the veneer 5 pierced by the piercing body 61 is hoisted while the rotation of the piercing body 61 being separated, which further increases the sustaining force applied to the veneer 5 due to the screw of the piercing body 61.

The vertical guide portion, the top position restricting portion and the bottom position restricting portion, in the construction according to the first to third embodiments (relating to the invention claimed in claim 1) may be integrally formed with the sustaining member or may be attached to the sustaining member after those portions are formed on a member other than the sustaining member.

Figure 10:
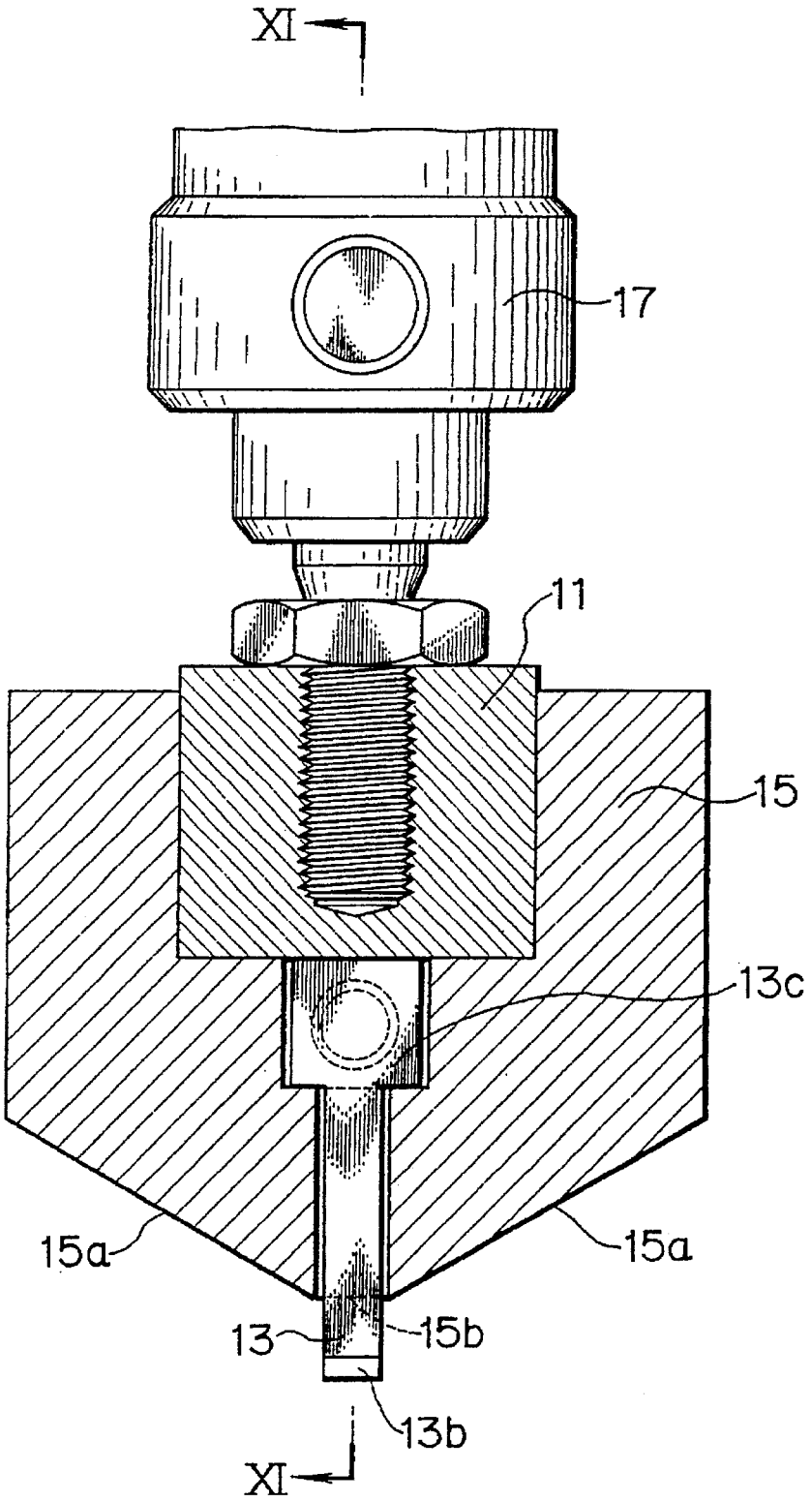
FIG. 10 is a partially cross-sectional view of the veneer hoisting apparatus that is observed in the direction of the fiber of the veneer in FIG. 4 in which the sustaining member 15 and the connecting member 11 are cut.
Figure 11:
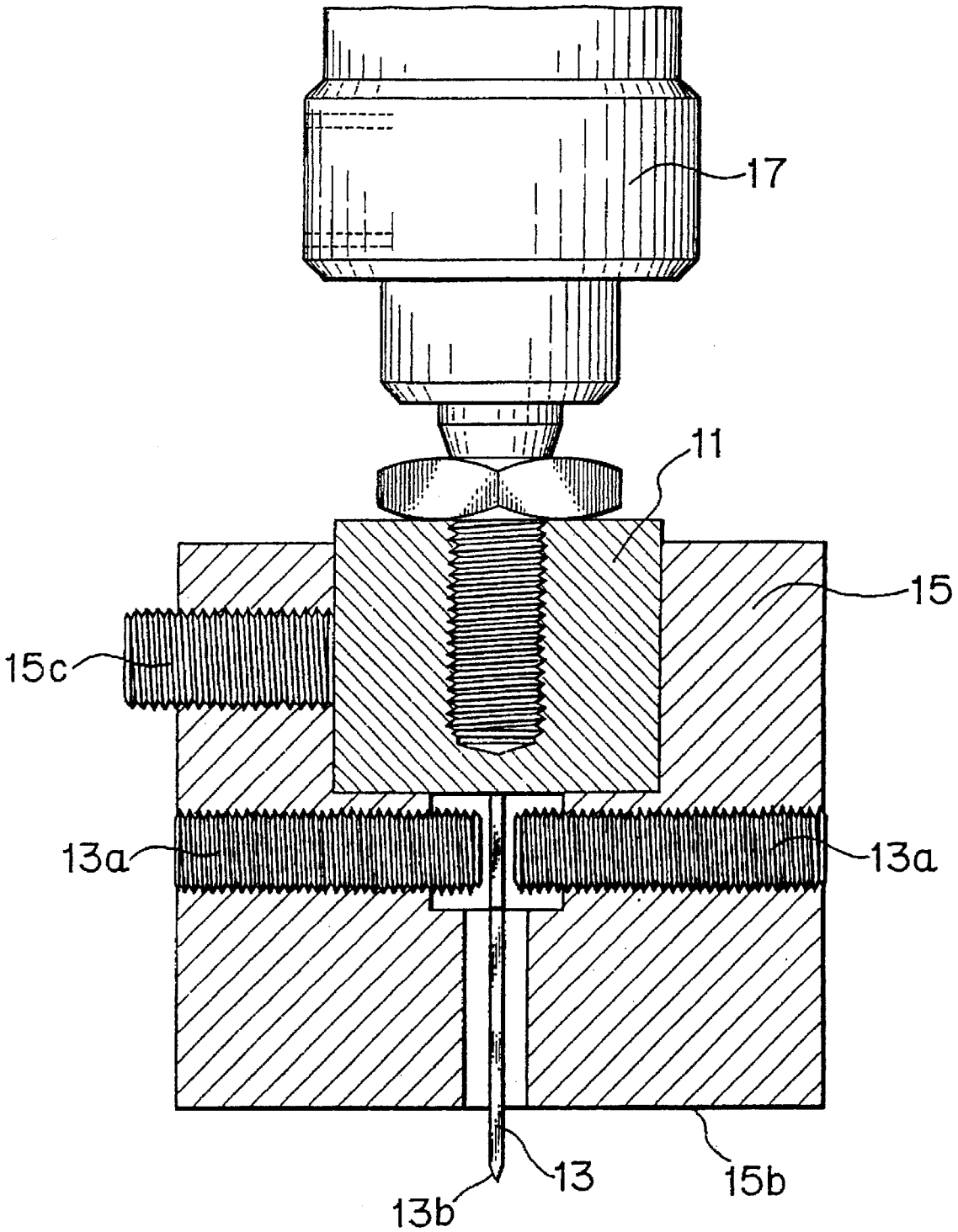
FIG. 11 is a partially cross-sectional view of the veneer hoisting apparatus taken along the line XI—XI in FIG. 10 in which the sustaining member 15 and connecting member 11 are cut.
Figure 12:
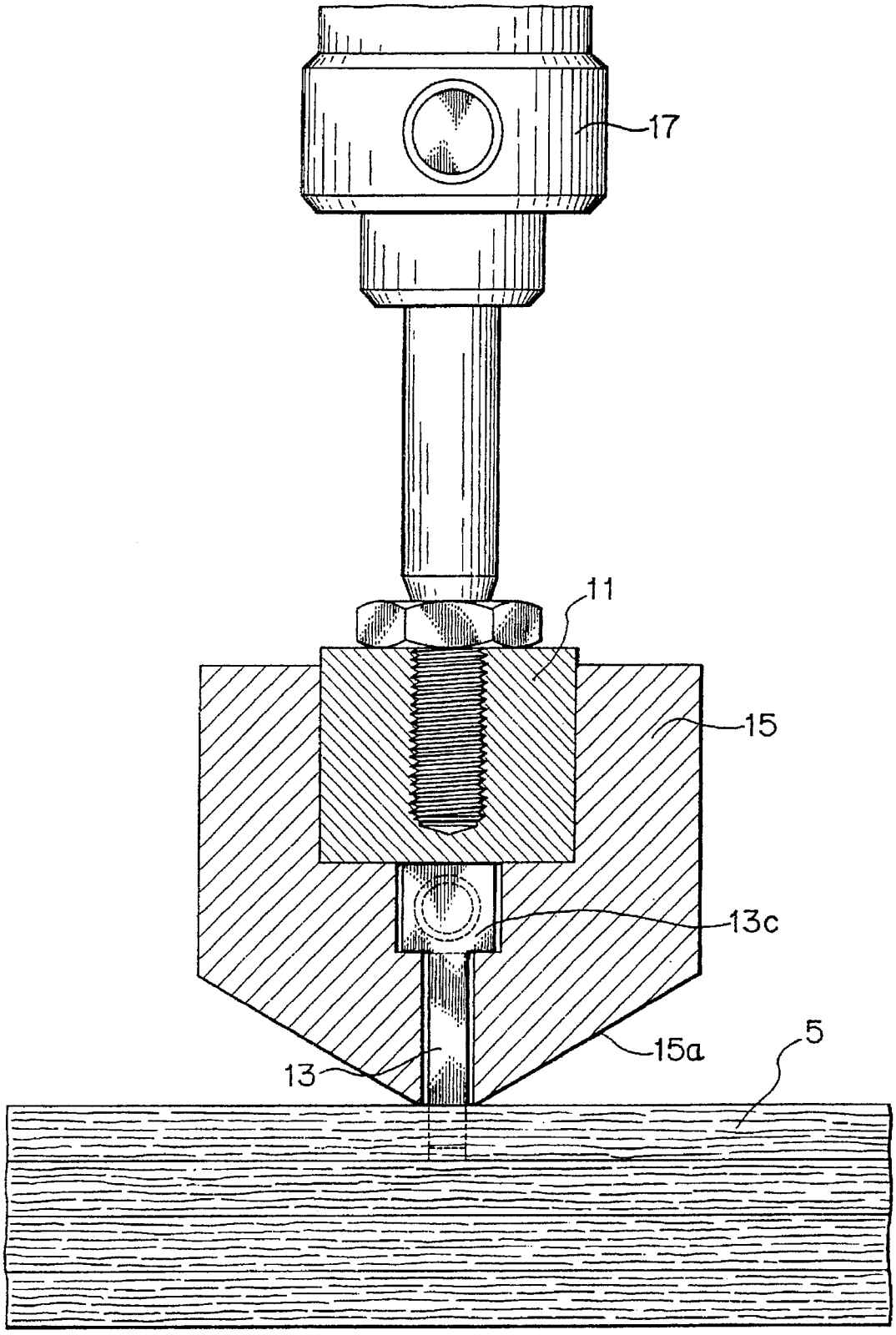
FIG. 12 is a view for explaining the motion of the veneer hoisting apparatus according to the fourth embodiment of the present invention.
Figure 13:
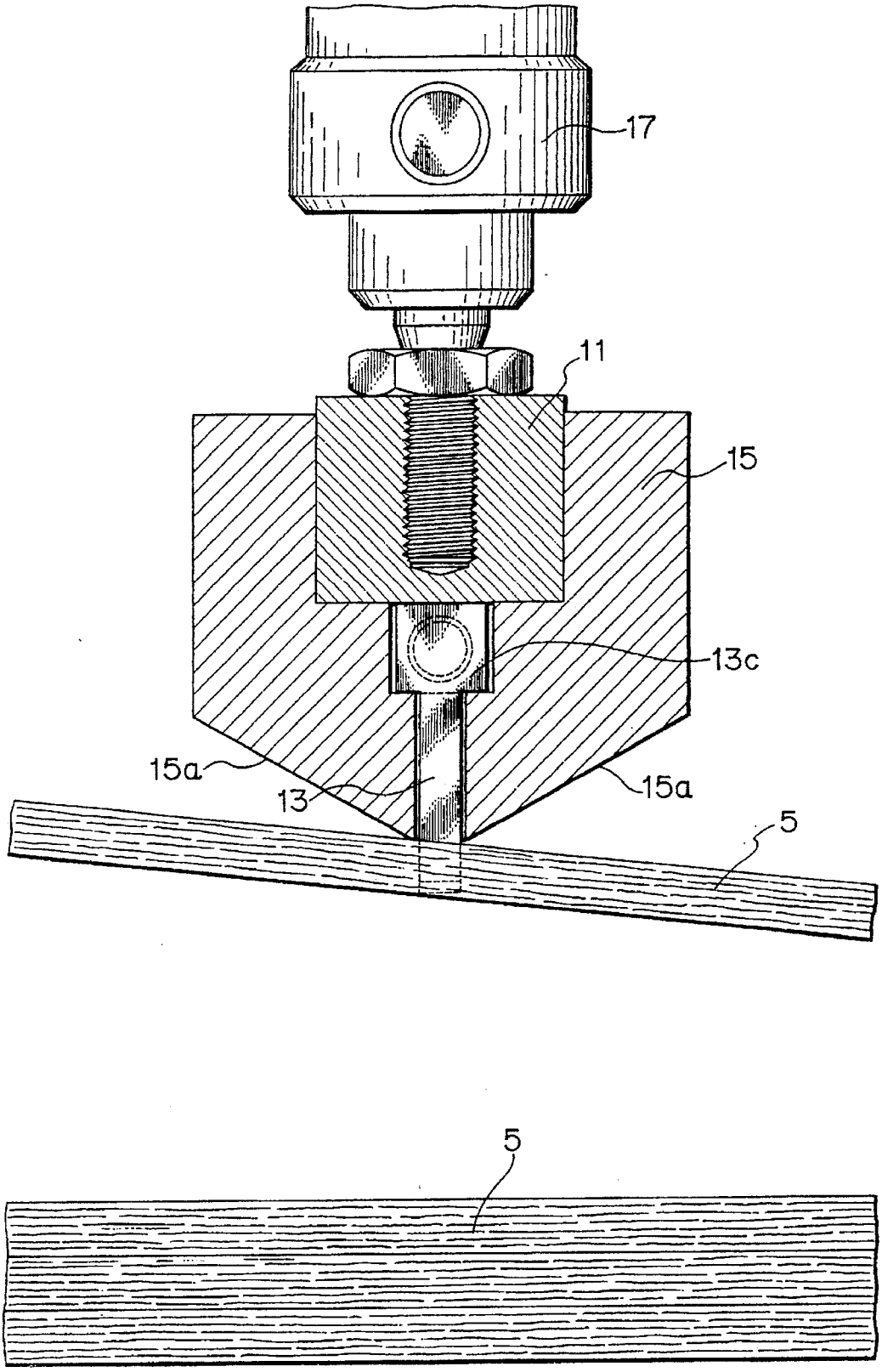
FIG. 13 is a view for explaining the motion of the veneer hoisting apparatus according to the fourth embodiment of the present invention.

Now, the fourth embodiment (an embodiment relating to the invention claimed in claim 2) will be explained with reference to FIGS. 10 to 13. FIG. 10 is a partially cross-sectional view of the veneer hoisting apparatus according to the present invention that is observed in the direction perpendicular to the fiber of the veneer, in which the sustaining member 15 and the connecting member 11 are cut, and FIG. 11 is a partially cross-sectional view of the veneer hoisting apparatus taken along the line XI—XI, in which the sustaining member 15 and the connecting member 11 are cut, and FIG. 12 is a partially cross-sectional view of the veneer hoisting apparatus when the veneer 5 is pierced by the piercing body 13, in which the sustaining member 15 and the connecting member 11 are cut, and FIG. 13 is a partially cross-sectional view of the veneer hoisting apparatus when the veneer 5 pierced by the piercing body 13 is hoisted in which the sustaining member 15 and connecting member 11 are cut. In comparison with the first embodiment, members other than the member which is vertically moved by the vertically transporting cylinder 17 are the same as those in the first embodiment in construction and motion, so that the explanation thereof will be omitted. Reference numeral 11 shows the connecting member attached to the piston rod of the vertically transporting cylinder 17 and piercing body 29 is a piercing body with a sharp tip 13*b* and a head 13*c*. Numeral 15 shows a sustaining member and is provided at a lower end portion thereof with a restricting bottom portion 15*b* (as illustrated in FIG. 11) for restricting the piercing depth of the piercing body 13 in the direction vertical to the fiber of a veneer, and faces 15*a* (as illustrated in FIG. 10) which are apart from each other as ascending in the direction of the fiber of a veneer, and is further provided with a hexagon head setscrew as a piercing body rotation preventing member 13*a* for preventing the rotation of the piercing body 13. Under the condition that the head 13*c* of the piercing body 13 is sustained by the sustaining member 15 and connecting member 11, the sharp tip 13*b* of the piercing body 13 projects downward from the restricting bottom portion 15*b* by the length corresponding to substantial thickness of the veneer 5.

With the above-mentioned construction, like the first embodiment, when a signal from the controller allows the piston rod of the vertically transporting cylinder 17 to be stretched, as illustrated in FIG. 12, the piercing body 13 pierces one veneer 15. Then, the restricting bottom portion 15*b* abuts the surface of the veneer 5, however, the faces 15*a* apart from each other do not contact the veneer 5.

After the piston rod of the vertically transporting cylinder 17 is stretched, like the first embodiment, a signal from the controller causes the piston rod of the vertically transporting cylinder 17 to be shrunk to hoist the sustaining member 15, so that the piercing body 13 elevates while piercing the veneer 5 (as illustrated in FIG. 13). At that time, the central portion side of the veneer 5 is positioned on the right side of FIG. 13, so that the right side of the veneer 5 is hung down, and the left side thereof elevates while being curved upward. But, the faces 15*a* of the sustaining member 15 which are apart from each other are over the veneer 5 with sufficient gap between the faces 43*a* and the veneer 5 in the direction of the fiber of a veneer, which prevents the surface of the veneer 5 from contacting the separate faces 15*a* of the sustaining member 15. Therefore, since the veneer 5 is pierced in the previous state, a fulcrum does not occur at a position apart from the root of the piercing body 13 in the direction of the fiber of the veneer so that no force is applied to the veneer by the piercing body on the basis of the theory of lever.

In the fourth embodiment described above, although the connecting member 11, the sustaining member 15 and the piercing body 13 are independent from each other, those members may integrally be formed with each other.

As described above, in the fourth embodiment, although the central portion side of the veneer in the direction of its fiber is hung down and the end side thereof is curved upward about the root of the piercing body 13 piercing the veneer 5 as a fulcrum, no fulcrum occurs at a position apart from the root of the piercing body 13 in the direction of the fiber of the veneer, permitting no force for detaching the veneer 5 from the piercing body 7 based on the theory of lever to act on the veneer. Therefore, it is prevented to decrease the sustaining force of the veneer 5 by the piercing body 13, and it rarely happens that the veneer 5 drops down from the piercing body 13.

Figure 14:
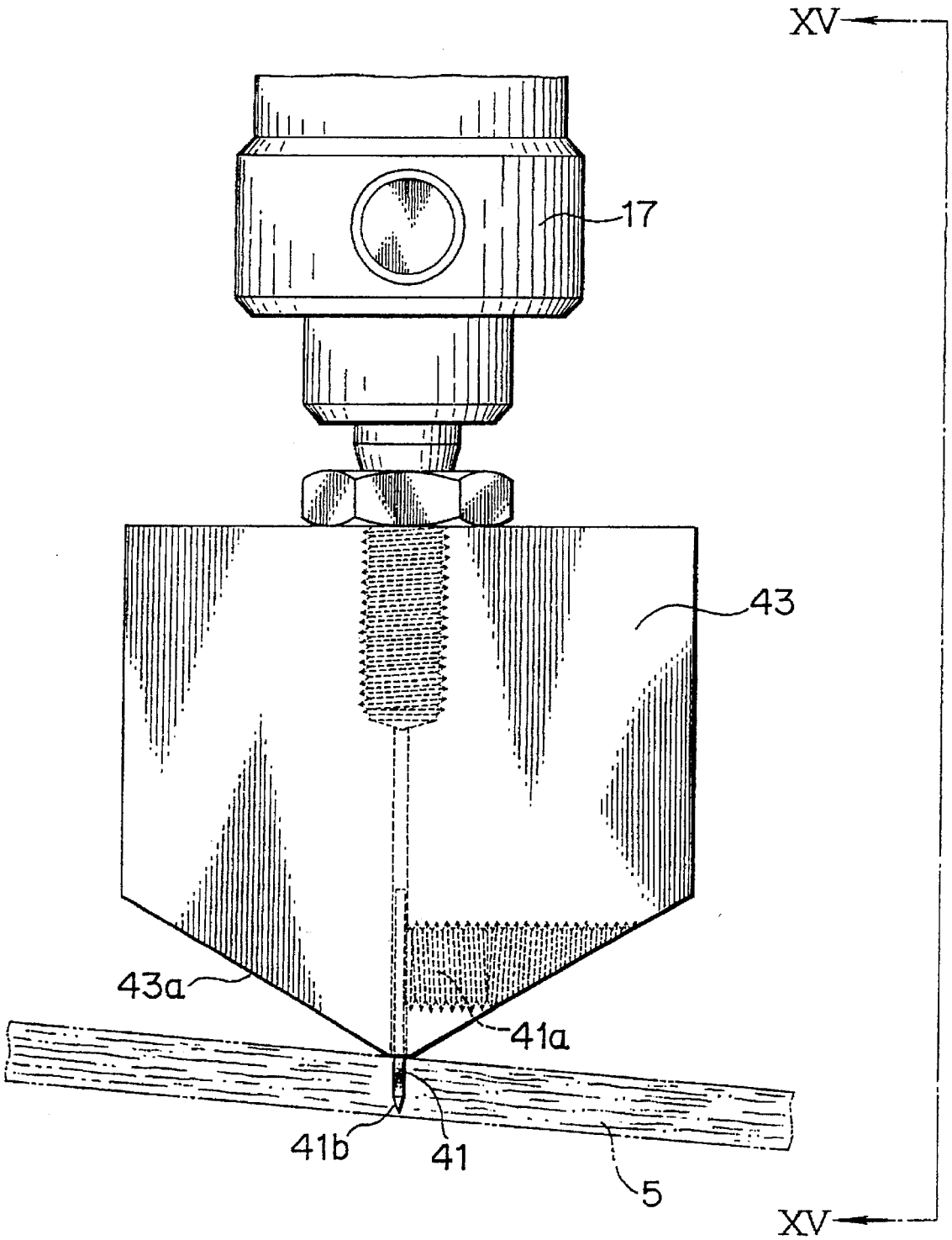
FIG. 14 is a view for explaining the veneer hoisting apparatus according to the fifth embodiment of the present invention which is observed in the direction of the fiber of a veneer.
Figure 15:
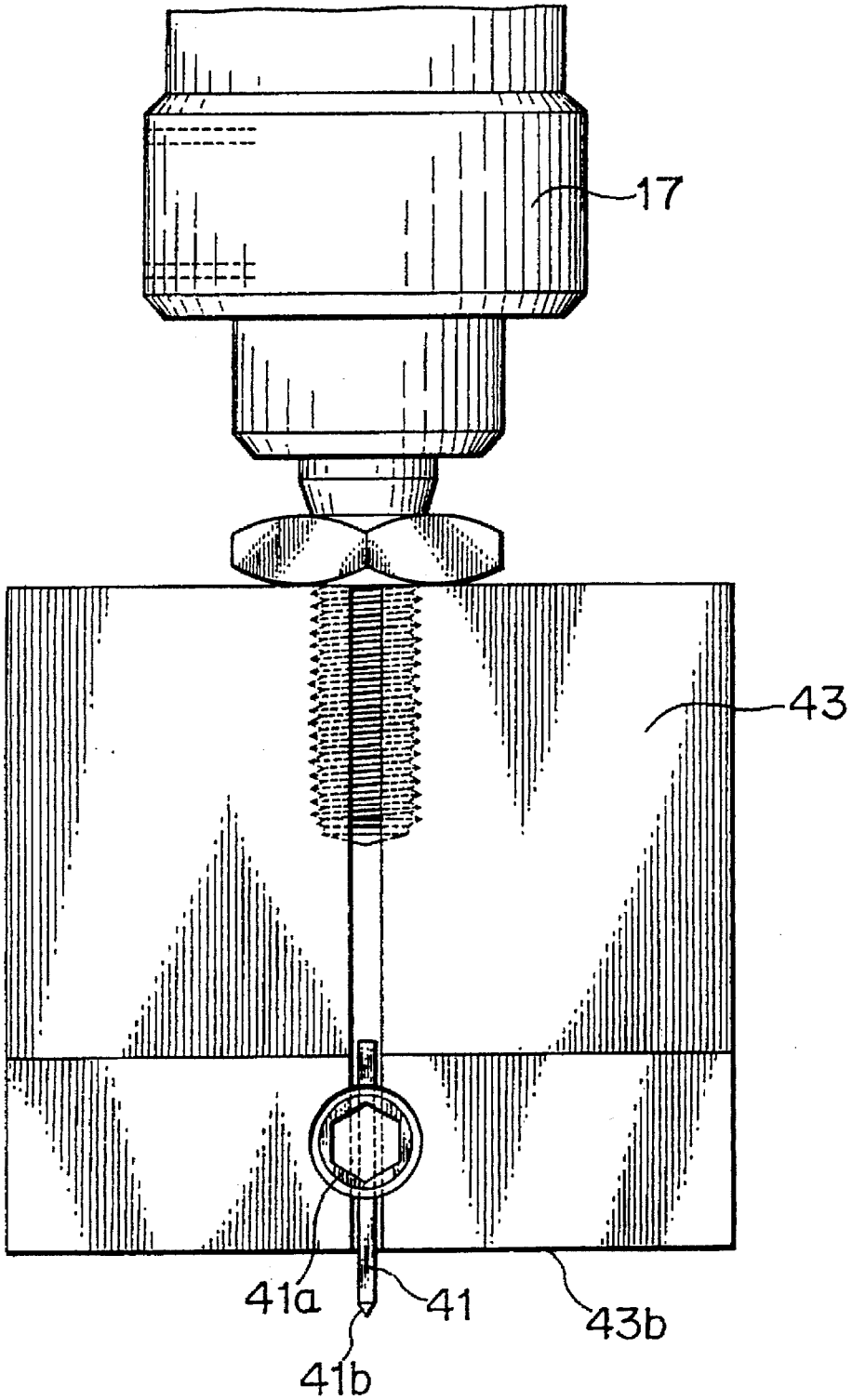
FIG. 15 is a view of the veneer hoisting apparatus in FIG. 14 observed from the line XV—XV.

The fifth embodiment (an embodiment relating to the invention claimed in claim 2) will be explained with reference to FIGS. 14 and 15. FIG. 14 is a partially cross-sectional view of the veneer hoisting apparatus according to the present invention which is observed in the direction perpendicular to the fiber of the veneer, and FIG. 15 is a view taken along the line XV—XV in FIG. 14. In comparison with the first embodiment, members other than the member which is vertically transported by the vertically transporting cylinder 17 are the same as those in the first embodiment in construction and motion, so that the explanation thereof will be omitted. Reference numeral 41 shows a needle-shaped piercing body and is provided with a sharp tip 41*b* at an end thereof. Numeral 43 shows a sustaining member and is provided at a lower end portion thereof with a restricting bottom portion 43*b* (as illustrated in FIG. 15) for restricting the piercing depth of the piercing body in the direction perpendicular to the fiber of a veneer, and faces 43*a* (as illustrated in FIG. 14) which are apart from each other as ascending in the direction of the fiber of a veneer, and is further provided with a hexagon head setscrew 41*a* for sustaining the piercing body 41. Under the condition that the piercing body 41 is sustained by the sustaining member 43, the sharp tip 41*b* of the piercing body 41 projects downward from the restricting bottom portion 43*b* by the length corresponding to substantial thickness of the veneer 5.

With the above-mentioned construction, like the first embodiment, when a signal from the controller allows the piston rod of the vertically transporting cylinder 17 to be stretched, the piercing body 41 pierces one veneer 5. Then, the restricting bottom portion 43*b* abuts the surface of the veneer 5, however, the faces 43*a* apart from each other do not contact the veneer 5.

After the piston rod of the vertically transporting cylinder 17 is stretched, like the first embodiment, a signal from the controller causes the piston rod of the vertically transporting cylinder 17 to be shrunk to hoist the sustaining member 43, so that the piercing body 41 elevates while piercing the veneer 5 (as illustrated in FIG. 14). At that time, the central portion side of the veneer 5 is positioned on the right side of FIG. 13, so that the right side of the veneer 5 is hung down, and the left side thereof elevates while being curved upward. But, the faces 43*a* of the sustaining member 43 which are over the veneer 5 with sufficient gap between the faces 43*a* and the veneer 5 in the direction of the fiber of a veneer, which prevents the surface of the veneer 5 from contacting the separate faces 43*a* of the sustaining member 43. Therefore, since the veneer 5 is pierced in the previous state, a fulcrum does not occur at a position apart from the root of the piercing body 41 in the direction of the fiber of the veneer, so that no force is applied to the veneer 5 by the piercing body 41 on the basis of the theory of lever.

In the fifth embodiment, although the sustaining member 43 and the piercing body 41 are independent from each other, those members may be formed integrally.

As described above, in the fifth embodiment, although the central portion side of the veneer in the direction of its fiber is hung down and the end side thereof is curved upward about the root of the piercing body 41 piercing the veneer 5 as a fulcrum, no fulcrum occurs at a position apart from the root of the piercing body 41 in the direction of the fiber of the veneer, permitting no force for detaching the veneer 5 from the piercing body 41 based on the theory of lever to act on the veneer. Therefore, it is prevented to decrease the sustaining force of the veneer 5 by the piercing body 41, and it rarely happens that the veneer 5 drops down from the piercing body 41.

Figure 16:
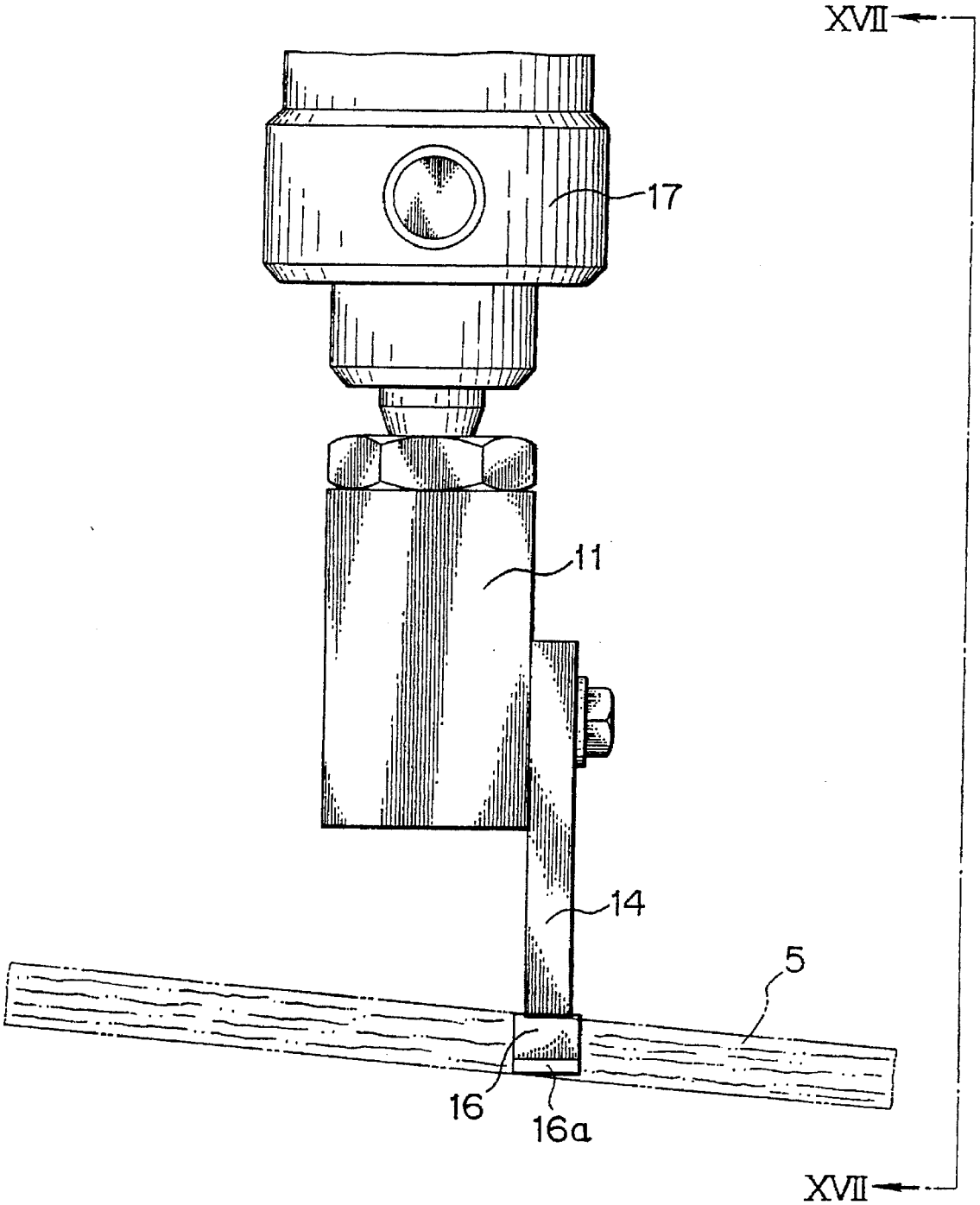
FIG. 16 is a view of the veneer hoisting apparatus according to the sixth embodiment observed in the direction of the fiber of a veneer.
Figure 17:
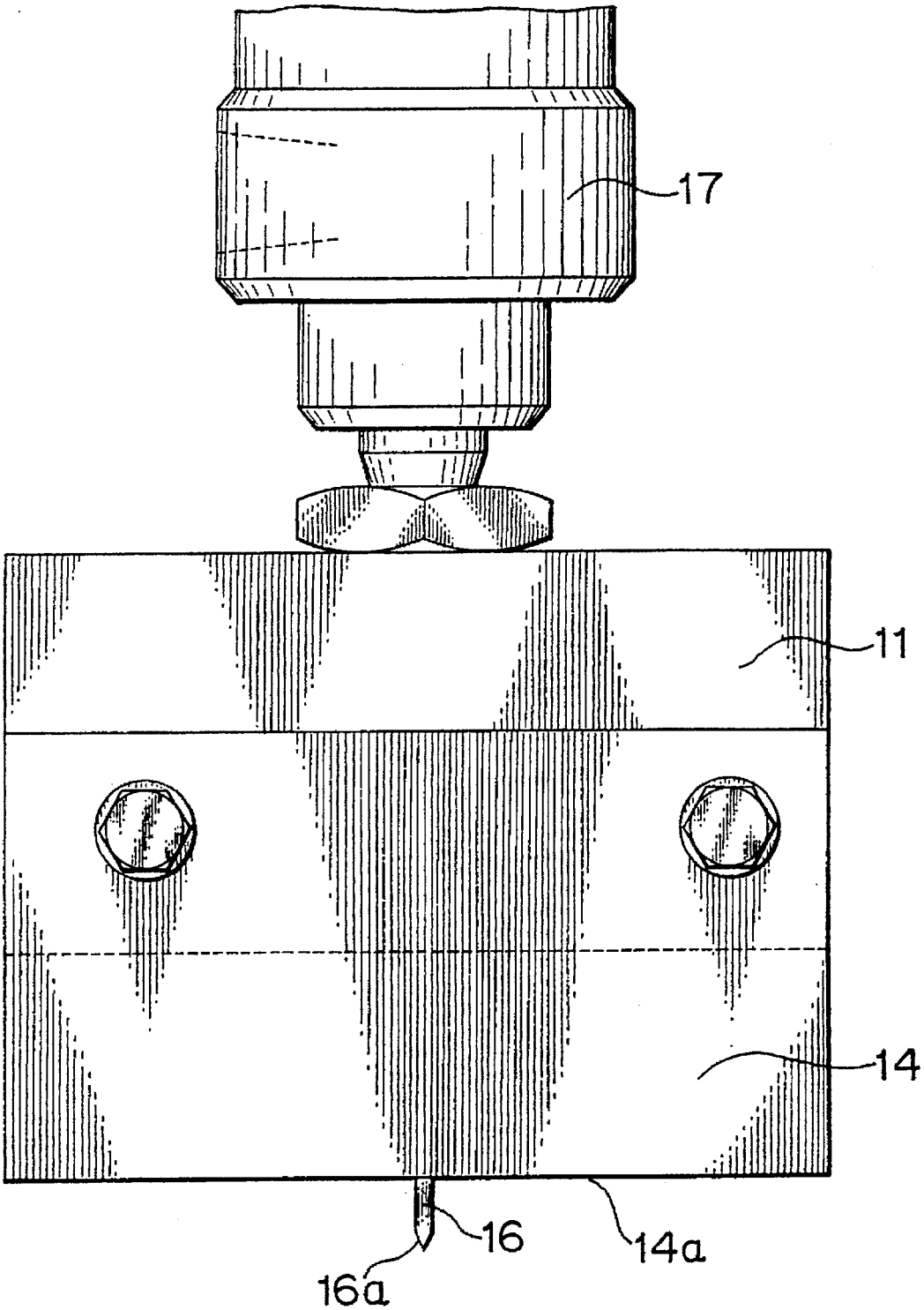
FIG. 17 is a view of the veneer hoisting apparatus in FIG. 16 observed from the line XVII—XVII.

The sixth embodiment (an embodiment relating to the invention claimed in claim 3) will be explained with reference to FIGS. 16 and 17. FIG. 16 is a partial view of the veneer hoisting apparatus according to the present invention which is observed in the direction perpendicular to the fiber of the veneer, and FIG. 17 is a view taken along the line D—D in FIG. 16. In comparison with the first embodiment, members other than the member which is vertically moved by the vertically transporting cylinder 17 are the same as those in the first embodiment in construction and motion, so that the explanation thereof will be omitted. Reference numeral 11 is the connecting member attached to the piston rod of the vertically transporting cylinder 17, and numeral 16 is a piercing body and is provided with a sharp tip 16*a*. Numeral 14 shows a sustaining member with the piercing body 16 projecting downward. At the border between the sustaining member 14 and piercing body 16 is provided a restricting bottom portion 14*a* (as illustrated in FIG. 17) for restricting the piercing depth of the piercing body 16 in the direction of the fiber of a veneer, and the dimension of the sustaining member 14 in the direction of the fiber of a veneer is formed so as to be smaller than that of the piercing body 16 at the border in the direction of the fiber, and the sharp tip 16*a* of the piercing body 16 projects downward from the restricting bottom portion 14*a* by the length corresponding to a substantial thickness of the veneer 5.

With the above-mentioned construction, like the first embodiment, when a signal from the controller allows the piston rod of the vertically transporting cylinder 17 to be stretched, the piercing body 16 pierces one veneer 5. Then, the restricting bottom portion 14*a* abuts the surface of the veneer 5, however, other portions do not touch the veneer 5.

After the piston rod of the vertically transporting cylinder 17 is stretched, like the first embodiment, a signal from the controller causes the piston rod of the vertically transporting cylinder 17 to be shrunk to hoist the sustaining member 43, so that the piercing body 16 elevates while piercing the veneer 5 (as illustrated in FIG. 16). At that time, the central portion side of the veneer 5 is positioned on the right side of FIG. 13, so that the right side of the veneer 5 is hung down, and the left side thereof elevates while being curved upward. But, since the dimension of the sustaining member 14 in the direction of the fiber of a veneer is formed so as to be smaller than that of the piercing body 16 at the border in the direction of the fiber, the veneer 5 does not touch any member at a position apart from the root of the piercing body 16 in the direction of the fiber of a veneer. Therefore, since the veneer 5 is pierced in the previous state, a fulcrum does not occur at a position apart from the root of the piercing body 16 in the direction of the fiber of the veneer so that no force is applied to the veneer 5 by the piercing body 16 on the basis of the theory of lever.

In the sixth embodiment, the sustaining member 14 and the piercing body 16 are integrally formed with each other, however, those members may be formed so as to be independent from each other.

As described above, in the sixth embodiment, although the central portion side of the veneer in the direction of its fiber is hung down and the end side thereof is curved upward about the root of the piercing body 16 piercing the veneer 5 as a fulcrum, no fulcrum occurs at a position apart from the root of the piercing body 16 in the direction of the fiber of the veneer, permitting no force for detaching the veneer 5 from the piercing body 16 based on the theory of lever to act on the veneer. Therefore, it is prevented to decrease the sustaining force of the veneer 5 by the piercing body 16, and it rarely happens that the veneer 5 drops down from the piercing body 16.

The elevating means in the first embodiment to the sixth embodiment may be selected from an air cylinder, a hydraulic cylinder, and a crank and the like.

The shape of the piercing body in the first embodiment to the six embodiment may be selected from a needle, a nail, and a plate and the like.

In the first embodiment to the sixth embodiment, signals are outputted from the controller based on the detecting signal from the detector, it may be possible to output signals from the controller based on signals from the next process in place of the detecting signals.

Figure 8:
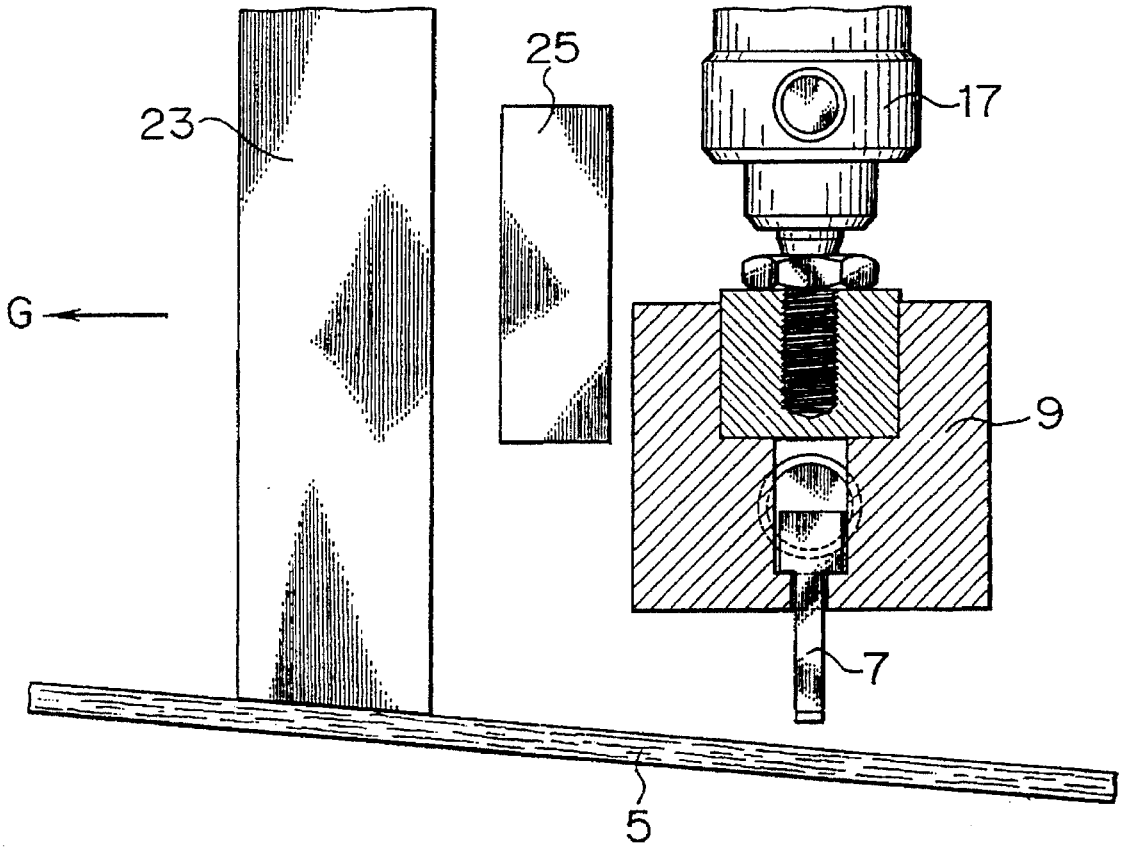
FIG. 8 is a view for explaining the improvement in the horizontally transporting means in the first embodiment to the sixth embodiment.
Figure 8:
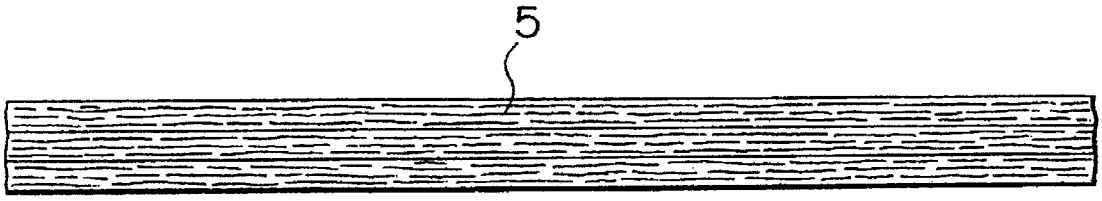

In the first embodiment to the sixth embodiment, the piercing body moves vertically and horizontally, however, the following construction may also be acceptable. That is, as illustrated in FIG. 8, the detector 25 and vacuum suction means 23 are disposed at the standby position before hoisting. Then, the motion of the piercing body 7 is limited in the vertical direction, the pierced veneer 5 is drawn by the suction member 23 as the piercing body 7 elevates. When the piercing body 7 is further elevated, the veneer 5 detaches from the piercing body 7 and is drawn by the suction member 23 only. Simultaneously, a detecting signal from the detector 25 which indicates the existence of a veneer is transmitted to the controller. Then, a signal from the controller causes the vacuum suction means 23 to move horizontally (in the direction indicated by the arrow G) through appropriate horizontally transporting means to transport the veneer to the next process.

The vertically transporting cylinder as vertically transporting means may be connected to the sustaining means directly or indirectly through other members.

With the present invention, although the central portion side of a veneer in the direction of the fiber of the veneer is hung down and the end portion side thereof is curved upward about the root of the piercing body as a fulcrum, no fulcrum occurs at a position apart from the root of the piercing body in the direction of the fiber of the veneer, permitting no force for detaching the veneer from the piercing body based on the theory of lever to act on the veneer. Therefore, it is prevented to decrease the sustaining force of the veneer by the piercing body, and it rarely happens that the veneer drops down from the piercing body.

What is claimed is:

1. A veneer hoisting apparatus for hoisting piled veneers from a top thereof comprising:

a piercing body with a sharp tip;

a sustaining member with a restricting bottom portion which abuts said top veneer, said sustaining member restricting a projecting length of the piercing body from the restricting a projecting length of the piercing body from said sustaining member sustaining the veneer while causing said piercing body to project by substantially the same length as a thickness of the veneer;

vertically transporting means for transporting said sustaining means between a position abutting the veneer and a position vertically spaced above the top of the piled veneers; and a controller for controlling motion of the vertically transporting means, wherein said sustaining member increases said projecting length of said piercing body when the sustaining member is position vertically spaced above the veneer by the vertically transporting means.

2. The veneer hoisting apparatus as claimed in claim 1, wherein said sustaining member includes vertical guide portions, a top position restricting portion and a bottom position restricting portion; said piercing body includes guided portions which are guided by the vertical guide portions, and an upper limit restricted portion and a lower limit restricted portion which are restricted by said both restricting portions of the sustaining member; and said piercing body and said sustaining member are connected to each other such that they are relatively vertically movable along the guided portions and the vertical guide portions.

3. The veneer hoisting apparatus as claimed in claim 2, wherein said vertical guide portions and said guided portions are engaged with each other while maintaining a play between them.

4. The veneer hoisting apparatus as claimed in claim 2, wherein a connecting means is provided between said sustaining member and said vertically transporting means; said top position restricting portion is formed on said connecting means; said piercing body is screwed at least at its sharp tip portion thereof and the upper limit restricted portion of the piercing body is formed as a flat surface; and said top position restricting portion contacts at one point with said upper limit restricted portion, whereby said piercing body is rotatable about an axis thereof.

5. A veneer hoisting apparatus for hoisting piled veneers from a top thereof comprising:

a piercing body with a sharp tip;

a sustaining member with a restricting bottom portion at a lower end portion thereof which abuts said top veneer, said sustaining member sustaining the veneer while causing said piercing body to project by substantially the same length as a thickness of the veneer;

vertically moving means for transporting said sustaining means between a position abutting the veneer and a position vertically spaced above the top of the piled veneers; and a controller for controlling motion of the vertically moving means, wherein the sustaining member includes at least one surface adjacent to the restricting bottom portion, extending away from said restricting bottom portion in an upwardly angled, non perpendicular direction away from the veneer.

6. The veneer hoisting apparatus of claim 5, wherein said at least one surface is a planar surface which rises upwardly along a direction of a fiber of the veneer and is horizontal in a direction perpendicular to the direction of the fiber of the veneer.

7. A veneer hoisting apparatus for hoisting piled veneers from a top thereof comprising:

a piercing body with a sharp tip;

a sustaining member with a restricting bottom portion at a lower end portion thereof which abuts said top veneer, said sustaining member sustaining the veneer while causing said piercing body to project by substantially the same length as a thickness of the veneer;

vertically moving means for transporting said sustaining means between a position abutting the veneer and a position vertically spaced above the top of the piled veneers; and a controller for controlling motion of the vertically moving means, wherein said piercing body has a first dimension at least the same dimension as said sustaining member in a veneer fiber direction and in a direction perpendicular to the veneer fiber direction, the piercing body has a second dimension substantially smaller than the first dimension.

* * * * *